US009486761B2

(12) United States Patent
Worley et al.

(10) Patent No.: US 9,486,761 B2
(45) Date of Patent: Nov. 8, 2016

(54) SLURRY DISPENSER FOR RADIOISOTOPE PRODUCTION

(75) Inventors: Mark D. Worley, Imperial, MO (US); Michael R. Mahoney, Wentzville, MO (US)

(73) Assignee: MALLINCKRODT NUCLEAR MEDICINE LLC, Hazelwood, MO (US)

( * ) Notice: Subject to any disclaimer, the term of this patent is extended or adjusted under 35 U.S.C. 154(b) by 764 days.

(21) Appl. No.: 13/808,721

(22) PCT Filed: Jul. 7, 2011

(86) PCT No.: PCT/US2011/043111

§ 371 (c)(1), (2), (4) Date: Jan. 7, 2013

(87) PCT Pub. No.: WO2012/009192

PCT Pub. Date: Jan. 19, 2012

(65) Prior Publication Data

US 2013/0107658 A1 May 2, 2013

Related U.S. Application Data

(60) Provisional application No. 61/364,430, filed on Jul. 15, 2010.

(51) Int. Cl.

| | |
|---|---|
| ***B01F 15/02*** | (2006.01) |
| ***B01F 3/12*** | (2006.01) |
| ***B01F 5/10*** | (2006.01) |
| ***B01F 9/06*** | (2006.01) |
| ***G21G 1/00*** | (2006.01) |

(52) U.S. Cl.

CPC ..... *B01F 15/0292* (2013.01); *B01F 3/12* (2013.01); *B01F 5/10* (2013.01); *B01F 9/06* (2013.01); *G21G 1/0005* (2013.01)

(58) Field of Classification Search

CPC ..... B01F 15/0292

USPC ..... 366/134, 136, 137, 167.1, 173.1, 173.2

See application file for complete search history.

(56) References Cited

U.S. PATENT DOCUMENTS

| | | | | |
|---|---|---|---|---|
| 1,093,723 | A | 4/1914 | Owens | |
| 3,231,245 | A | 1/1966 | Harvey | |
| 3,971,494 | A | 7/1976 | Rosen | |
| 4,105,045 | A * | 8/1978 | Althausen | B29B 7/7631 137/563 |

(Continued)

FOREIGN PATENT DOCUMENTS

| | | |
|---|---|---|
| WO | 2004103540 | 12/2004 |

*Primary Examiner* — David Sorkin
*Assistant Examiner* — Abbas Rashid
(74) *Attorney, Agent, or Firm* — Marsh Fischmann & Breyfogle LLP

(57) ABSTRACT

A slurry dispensing system (10) is disclosed. A peristaltic pump (28) may direct a flow of slurry out of a horizontal mixer (20) to a slurry dispenser (140). This slurry dispenser (140) may be operated on a programmed manner by a controller (260) to dispense slurry into a container (36). Both a bypass valve (172) and a dispensing valve (204) of the slurry dispenser may be opened/closed on a programmed basis by the controller (260) to deliver slurry to a container (36), such as a glass column. Slurry may be intermittently directed into a metering chamber (194) of the slurry dispenser (140), while the remainder of the slurry being directed into the slurry dispenser (140) may be recirculated back to the horizontal mixer (20).

29 Claims, 11 Drawing Sheets

(56) References Cited

U.S. PATENT DOCUMENTS 4,136,970 A * 1/1979 Cabrera ..... B01F 13/0277 366/101
4,274,962 A 6/1981 Queiser et al.
4,415,267 A * 11/1983 Hill ..... E01C 19/08 366/137
4,474,310 A * 10/1984 Muller ..... B29B 7/7631 222/145.5
4,482,704 A * 11/1984 Luetzelschwab ..... B01F 3/088 137/1
4,510,993 A * 4/1985 Luetzelschwab ..... C09K 8/588 137/504
4,830,505 A 5/1989 Dunton et al.
4,904,451 A * 2/1990 Proksa ..... B29B 7/7615 239/124
4,912,681 A 3/1990 Halsey et al.
4,973,167 A 11/1990 Zmarlicki
5,093,084 A * 3/1992 Boden ..... B29B 7/7684 366/162.5
5,201,580 A * 4/1993 Bauer ..... B29B 7/7663 366/159.1
5,590,960 A * 1/1997 Clinton ..... B01F 13/10 366/134
6,955,779 B2 * 10/2005 Massarotto ..... B29B 7/7621 264/51
2002/0034122 A1 * 3/2002 Lemke ..... B24B 37/04 366/136
2004/0249105 A1 * 12/2004 Nolte ..... B01F 3/088 528/44
2009/0073798 A1 3/2009 Wallgren

* cited by examiner

SLURRY DISPENSER FOR RADIOISOTOPE PRODUCTION

CROSS REFERENCE TO RELATED APPLICATIONS

This patent application is a U.S. National Stage of PCT/US2011/043111, filed 7 Jul. 2011, which is a non-provisional application of and claims the benefit of U.S. Provisional Application No. 61/364,430 filed Jul. 15, 2010. Priority is claimed to each patent application set forth in this Cross-Reference to Related Applications section, and the entire disclosure of each such patent application which is incorporated herein in its entirety.

FIELD OF THE INVENTION

The present invention generally relates to mixing and dispensing adsorbent materials into chemical containers or columns utilized in chromatographic processes and, more particularly, to the mixing and dispensing of an abrasive slurry into a container or column from which radioisotopes may be produced.

BACKGROUND

Glass columns of aluminum oxide (alumina) may be used in the process of column chromatography. This may entail adding solvents and other chemicals to the column of alumina to initiate a chemical reaction that produces radioisotopes. These radioisotopes may be used for medical diagnosis, treatment, and research.

Dispensing alumina into a glass column is typically done by hand and is a very labor intensive process. Moreover, if the column of alumina contains particles that are unevenly distributed, the subsequent chemical processing that produces the radioisotopes may be skewed.

SUMMARY

A first aspect of the present invention is embodied by a horizontal mixer. This mixer includes a container or tumbler that is able to rotate about an at least substantially horizontally disposed rotational axis, an inner sidewall that is disposed about this rotational axis (e.g., extends a full 360° about this rotational axis), and a mixing chamber that is at least partially defined by this inner sidewall. Multiple blades or fins extend from the inner sidewall of the container and in the direction of an interior of the mixing chamber (e.g., defining protrusions on the inner sidewall). These blades are oriented to direct fluid toward an outlet from the mixing chamber for at least a certain rotational angle and during rotation of the container in a first rotational direction about its rotational axis.

A second aspect of the present invention is embodied by a horizontal mixer. This mixer includes a container or tumbler having first and second container/tumbler ends that are spaced along an at least substantially horizontally disposed rotational axis of the container. An inner sidewall of the container is disposed about its rotational axis and extends between the first and second container ends. The first and second container ends, along with the inner sidewall, at least partially define a mixing chamber for the container. An outlet accommodates a discharge from the mixing chamber.

A plurality of first blades or fins and a plurality of second blades or fins each extend from the inner sidewall of the container and in the direction of an interior of the mixing chamber (e.g., defining protrusions on the inner sidewall) in the case of the second aspect. Each of the first and second blades has a first blade end and a second blade end. Each first blade extends from its corresponding first blade end toward its corresponding second blade end at least generally in the direction of the second container end (e.g., the second blade end of each first blade may be characterized as being between its corresponding first blade end and the second container end relative to a dimension in which the rotational axis of the container extends (hereafter a "longitudinal dimension)). Each second blade extends from its corresponding first blade end toward its corresponding second blade end at least generally in the direction of the first container end (e.g., the second blade end of each second blade may be characterized as being between its corresponding first blade end and the first container end relative to the longitudinal dimension). In the case of the second aspect, the first blade end of each first and second blade leads its corresponding second blade end in a first rotational direction for the container.

A number of feature refinements and additional features are separately applicable to each of the first and second aspects of the present invention. These feature refinements and additional features may be used individually or in any combination. As such, each of the following features that will be discussed may be, but are not required to be, used with any other feature or combination of features of the first and/or second aspects. The following discussion is separately applicable to each of the first and second aspects, up to the start of the discussion of a third aspect of the present invention. Initially, each feature of the first aspect may be used by the second aspect, alone or in any combination, and vice versa.

Each blade used by the horizontal mixer may be of any appropriate size, shape, configuration, and/or type. For instance, each blade may be in the form of a plate having a pair of oppositely disposed flat or planar surfaces. Although each blade may be of an identical configuration and size, such may not be the case in all instances. Any appropriate number of blades may be utilized by the horizontal mixer, and the blades may be integrated with the container in any appropriate manner (e.g., by being separately attached to the inner sidewall of the container; by being integrally formed with the container such that there is no joint of any kind between the inner sidewall of the container and each of its blades).

The blades may be arranged on the inner sidewall of the container to promote a desired mixing action of contents within the mixing chamber of the horizontal mixer. The blades may extend along the inner sidewall of the container in non-parallel relation to the rotational axis of the horizontal mixer. The blades may be oriented so as to be "center angled." One embodiment has the length dimension of each blade (the length dimension of a blade coinciding with the direction that the blade extends along the inner sidewall of the container) proceeding in a direction so as to direct fluid toward the outlet from the mixing chamber throughout at least a certain rotational angle of the container proceeding in the first rotational direction. Each blade may be oriented relative to the inner sidewall so as to bias a fluid flow toward the outlet throughout at least a certain rotational angle of the container proceeding in the first rotational direction.

The blade orientation may be described in relation to the location of its two blade ends—the spacing between which corresponds with the length dimension of the blade. The two blade ends of each blade, at its intersection with the inner sidewall of the container may be disposed at different elevations relative to a horizontal reference plane that is disposed below the horizontal mixer. Although the elevation of this intersection could continually change between these two blades ends in this instance, such may not always be the case.

The two ends of each blade may be disposed on different reference axes that are each parallel to the rotational axis of the tumbler. Consider the case where each blade has a first blade end and an oppositely disposed second blade end. The first blade end of a given blade may be disposed on a first reference axis and the second blade end may be disposed on a different second reference axis, where each of the first and second reference axes are parallel to the rotational axis of the horizontal mixer. Stated another way, the first and second blade ends of each blade may be characterized as being located at different angular positions, measured relative to the rotational axis of the tumbler.

The end of each blade that is adjacent-most to an end of the horizontal mixer may lead its opposite end in a first rotational direction for the container. Consider the case where a first blade end of a blade is disposed between a first container end of the horizontal mixer and its oppositely disposed second blade end proceeding in the longitudinal dimension. During rotation of the container in a first rotational direction, the first blade end of the noted blade will pass the 6 o'clock position before its second blade end passes this same 6 o'clock position when the first blade end leads the second blade end in the first rotational direction. The second blade end could also be characterized as lagging its corresponding first blade end during rotation of the container in this same first rotational direction.

Each of the first and second aspects may utilize both a plurality of first blades and a plurality of second blades, where each of the first and second blades has a first blade end and a second blade end, where each first blade extends from its corresponding first blade end toward its corresponding second blade end at least generally in the direction of a second container end of the container for the horizontal mixer (e.g., the second blade end of each first blade may be characterized as being between its corresponding first blade end and the second container end relative to or proceeding along the rotational axis of the container), where each second blade extends from its corresponding first blade end toward its corresponding second blade end at least generally in the direction of a first container end of the container for the horizontal mixer (e.g., the second blade end of each second blade may be characterized as being between its corresponding first blade end and the first container end relative to or proceeding along the rotational axis of the container), and where the first blade end of each first and second blade leads its corresponding second blade end in a first rotational direction for the container. The following discussion, up to the start of the discussion of a third aspect of the present invention, pertains to such a configuration.

The first blade end of each first blade may be located at or at least generally proximate to the first container end, while the first blade end of each second blade may be located at or at least generally proximate to the second container end (where the first and second container ends again are spaced along the rotational axis of the horizontal mixer). The horizontal mixer may be characterized as including a plurality of blade pairs, where each blade pair includes one first blade and one second blade. The first and second blades of each blade pair may be oriented as the mirror image of each other. Each blade pair may define at least generally V-shaped configuration. Each blade pair may collectively define a concave profile relative to the first rotational direction. A space between the blades of each blade pair may define the trailing portion of the blade pair when the container is rotated about its rotational axis in the first rotational direction.

The position of the plurality of second blades could be staggered in relation to the position of the plurality of first blades. The first blade end of each first blade could be disposed at a different angular position (relative to the rotational axis of the container) than the first blade end of each second blade. Consider the case where there are 6 first blades and 6 second blades. The first blade ends of the 6 first blades could be disposed at the 1, 3, 5, 7, 9, and 11 o'clock positions in a first static position for the container, while the first ends of the 6 second blades could be disposed at the 2, 4, 6, 8, 10, and 12 o'clock positions in this same first static position, or vice versa.

The length dimension of the various first and second blades may be disposed at a common angle relative to a reference axis that intersects their corresponding second blade end and that is parallel to the rotational axis of the horizontal mixer. Stated another way, the same angle may be defined between the length of each blade and a reference axis that intersects its second blade end and that is parallel to the rotational axis. Another option would be for the length dimension of the plurality of first blades to be disposed at a common first angle relative to a reference axis that intersects their corresponding second blade end and that is parallel to the rotational axis of the horizontal mixer, for the length dimension of the plurality of second blades to be disposed at a common second angle relative to a reference axis that intersects their corresponding second blade end and that is parallel to the rotational axis of the horizontal mixer, and for the magnitudes of the first and second angles to be different.

The plurality of first blades may coincide with or define a first longitudinal segment of the horizontal mixer, the plurality of second blades may coincide with or define a third longitudinal segment of the horizontal mixer, and a second longitudinal segment of the horizontal mixer may be located between the first and third longitudinal segments. The longitudinal dimension may coincide with the rotational axis of the horizontal mixer. In any case, the second longitudinal segment may include the outlet. One embodiment has the first, second, and third longitudinal segments being disposed in non-overlapping relation. Another embodiment has the first, second, and third longitudinal segments being disposed in end-to-end relation and in the noted order.

The outlet from the mixing chamber may be located between the second ends of the various first blades and the second ends of the various second blades. The second ends of the various first blades may be spaced from the second ends of the various second blades in a direction coinciding with the rotational axis of the horizontal mixer, and the outlet from the mixing chamber may be located within this space. In one embodiment, the outlet from the mixing chamber may be at least substantially mid-way between the first and second container ends of the horizontal mixer.

The first container end may include an aperture, and the horizontal mixer may further include an outlet conduit that extends through this aperture and into the mixing chamber. The aperture may be significantly larger than the outer diameter of the portion of the outlet conduit that passes therethrough. A first outlet conduit section may extend through this aperture and at least generally in the direction of the oppositely disposed second container end (e.g., at least generally parallel with the rotational axis of the horizontal mixer), and a second outlet conduit section may extend from the first outlet conduit section in at least a generally downward direction and may terminate prior to reaching the inner sidewall of the container to define the outlet from the mixing chamber. This second outlet conduit section may be disposed within the space between the second blade ends of the various first blades and the second blade ends of the various second blades. Other outlet configurations may be appropriate. It should be noted that the fluid level within the mixing chamber may be controlled such fluid does not spill out of the noted aperture in the first container end (e.g., the fluid level may be below the rotational axis of the container, including significantly below).

A third aspect of the present invention is directed to a fluid system that utilizes a horizontal mixer, at least one feed source, and a slurry target. The horizontal mixer includes a container that may rotate about an at least substantially horizontally disposed axis ("rotational axis"). An inner sidewall of this container is disposed about the rotational axis and at least partially defines a mixing chamber for the horizontal mixer. The horizontal mixer further includes a plurality of blades that extend from and rotate with the inner sidewall (e.g., such that the blades extend within the mixing chamber). An outlet exists for the mixing chamber. Fluid and a plurality of particles may be directed into the horizontal mixer in any appropriate manner, and a discharge from the outlet of the horizontal mixer may be in the form of a slurry that is directed to the slurry target.

A number of feature refinements and additional features are applicable to the third aspect of the present invention. These feature refinements and additional features may be used individually or in any combination. As such, each of the following features that will be discussed may be, but are not required to be, used with any other feature or combination of features of the third aspect. The following discussion is applicable to the third aspect, up to the start of the discussion of a fourth aspect of the present invention. Initially, the horizontal mixer discussed above in relation to the first aspect may be used by this third aspect. The horizontal mixer discussed above in relation to the second aspect may be used by this third aspect as well. Any of the features of the horizontal mixer discussed above in relation to the first and/or second aspects may be utilized by the horizontal mixer that is utilized by this third aspect, individually or in any combination.

The fluid system may utilize two or more separate feed sources. One feed source may contain a supply of particles, while another feed source may contain a supply of an appropriate fluid (e.g., one or more appropriate liquids). Each feed source could provide a direct flow or a separate stream to the horizontal mixer. Alternatively, the output from two or more feed sources could be combined before actually being directed into the horizontal mixer (e.g., into a common inlet manifold or header). A given feed source could contain both particles and fluid for a slurry.

Any appropriate type of particulates may be introduced into the horizontal mixer and in any appropriate manner. In one embodiment, alumina is directed into the horizontal mixer, and alumina slurry is removed from the horizontal mixer and is ultimately directed into a glass column, vial, container, or the like for use in the process of column chromatography. Solvents and other chemicals may be added to the column of alumina to initiate a chemical process that produces radioisotopes. The resulting radioisotopes may be used for any appropriate application, such as for medical diagnosis, medical treatment, or medical research. As such, the fluid system of the third aspect may be characterized as one that provides slurry from which isotopes may be produced, including radioisotopes. If the column of alumina contains particles that are unevenly distributed, the chemical process that produces the radioisotope may be skewed. The horizontal mixer described in relation to the first and second aspects may provide a desired degree of homogeneity for slurry from which isotopes may be produced.

The slurry target may be of any appropriate type. One embodiment has the slurry target in the form of a dispenser that is used to provide slurry to an end-use container (e.g., a glass column, vial, or other container). Another embodiment has the slurry target being in the form of an end-use container. Although the slurry may be of any appropriate type and used for any appropriate application, in one embodiment the slurry contains abrasive particulate matter for nuclear medicine applications.

A fourth aspect of the present invention is embodied by a method of providing slurry. A mixer is used to provide the slurry, and includes first and second mixer ends that are spaced along a first axis that is at least substantially horizontally disposed. A plurality of particles and fluid may be directed into the mixer. The mixer may be rotated about the first axis. A first flow is directed from the first mixer end toward a first location within the mixer that is located between the first and second mixer ends. Similarly, a second flow is directed from the second mixer and toward this same first location. The slurry is withdrawn from the first location of the mixer, and includes a distribution of the particles in the fluid.

A number of feature refinements and additional features are applicable to the fourth aspect of the present invention. These feature refinements and additional features may be used individually or in any combination. As such, each of the following features that will be discussed may be, but are not required to be, used with any other feature or combination of features of the fourth aspect. The following discussion is applicable to at least the fourth aspect. Initially, the horizontal mixer discussed above in relation to the first aspect may be used by this fourth aspect to mix the particles and fluid to define the slurry. The horizontal mixer discussed above in relation to the second aspect may be used by this fourth aspect as well to mix the particles and fluid to define the slurry. Any of the features of the horizontal mixer discussed above in relation to the first and/or second aspects may be utilized by the horizontal mixer that is part of this fourth aspect, individually or in any combination.

A first stream of particles may be directed into the mixer. A separate, second stream of fluid may be directed into the mixer. Another option is for a first stream of particles and a second stream of fluid to be combined before being introduced into the mixer. A single stream of particles and fluid could be directed into the mixer as well. In one embodiment, the particles are in the form of alumina.

Fluid may be directed to the first location using gravitational forces. For instance, the orientation of the blades discussed above in relation to the first, second, and third aspects may be used to induce a gravitational flow along the blades in the direction of the first location through at least a certain rotational angle of the mixer. The induced flow toward the first location within the mixer may be the result of exerting a lifting force on a portion of the contents within the mixer and simultaneously inducing a pressure gradient on this portion of the contents. For instance, a blade on an inner sidewall of the mixer may be rotated into the fluid, and during continued rotation may exert both a lifting force on a portion of the fluid (and any particles therein) and may direct this fluid portion toward the first location.

Slurry may be withdrawn from the horizontal mixture (e.g., via pump, such as a peristaltic pump) and provided to a dispenser of any appropriate type. Slurry provided to the dispenser may be directed to multiple locations. One is a container (e.g., a glass column, vial, or the like). Another is a recirculation loop back to the horizontal mixer. In one embodiment, slurry enters the dispenser and is provided to a container. In one embodiment, at least part of the slurry that is directed into the dispenser is recirculated back to the horizontal mixer. Slurry that is delivered to a container may be used to produce isotopes, and including radioisotopes.

A fifth aspect of the present invention is embodied by a slurry dispensing system that uses a slurry mixer and a slurry dispenser, where at least one flow path extends between the slurry mixer and slurry dispenser. The slurry mixer includes a mixer outlet and a mixer recirculation port. The slurry dispenser includes a slurry bypass channel, a metering chamber, a metering chamber inlet valve (which may also be referred to herein as a "slurry bypass valve") that is disposed between the slurry bypass channel and the metering chamber (e.g., to control a flow of slurry into the metering chamber), and a metering chamber outlet valve (which may also be referred to herein as a "dispensing valve") for the metering chamber (e.g., to control a flow of slurry out of the metering chamber).

A number of feature refinements and additional features are applicable to the fifth aspect of the present invention. These feature refinements and additional features may be used individually or in any combination. As such, each of the following features that will be discussed may be, but are not required to be, used with any other feature or combination of features of the fifth aspect. The following discussion is applicable to the fifth aspect, up to the start of the discussion of a sixth aspect of the present invention. Initially, the horizontal mixer discussed above in relation to the first and second aspects may be used by this fifth aspect. Moreover, the slurry dispenser from this fifth aspect may be used in conjunction with each of the third and fourth aspects discussed above.

At least one feed source may be fluidly connected with the slurry mixer (e.g., via a flow path extending therebetween, including where the flow through this flow path may be controlled in any appropriate manner, for instance by one or more valves). The slurry dispensing system may utilize two or more separate feed sources. One feed source may contain a supply of particles (e.g., alumina), while another feed source may contain a supply of an appropriate fluid (e.g., one or more appropriate liquids, such as distilled water). Each feed source could provide a direct flow or a separate stream to the mixer. Alternatively, the output from two or more feed sources could be combined before actually being directed into the mixer (e.g., into a common inlet manifold or header). A given feed source could contain both particles and an appropriate fluid for a slurry (e.g., a single feed source could be utilized in relation to this fifth aspect).

Any appropriate type of particulates may be introduced into the mixer and in any appropriate manner. In one embodiment, alumina is directed into the mixer, and alumina slurry is removed from the mixer and ultimately may be directed into a glass column, vial, container, or the like for use in the process of column chromatography. Solvents and other chemicals may be added to the column of alumina to initiate a chemical process that produces radioisotopes. The resulting radioisotopes may be used for any appropriate application, such as for medical diagnosis, medical treatment, or medical research. As such, the slurry dispensing system of the fifth aspect may be characterized as one that provides slurry from which isotopes may be produced, including radioisotopes.

A pump may be used to direct slurry from the mixer to the slurry dispenser. For instance, such a pump may be disposed in a line or flow path extending from the mixer outlet to a dispenser inlet port of the slurry dispenser. In one embodiment, the pump is a peristaltic pump. A peristaltic pump typically uses one or more rollers or the like (e.g., free-spinning structures) that are mounted on a rotatable rotor, where each such roller may progressively occlude tubing located in a tubing channel between the rotor (e.g., a rotating structure) and a stator (e.g., a stationary structure) of the peristaltic pump.

The slurry bypass channel may extend from a dispenser inlet port to a dispenser recirculation port. An outlet line (e.g., tubing or conduit of any appropriate type) may extend from the mixer outlet to the dispenser inlet port. A recirculation line may extend from the dispenser recirculation port to a mixer recirculation port. As such, slurry from the mixer may flow into the slurry dispenser and back to the mixer.

The slurry dispenser may further include a slurry inlet channel. This slurry inlet channel may extend from the slurry bypass channel to the metering chamber. For instance, the slurry inlet channel may intersect the slurry bypass channel somewhere between the dispenser inlet port and the dispenser recirculation port. The metering chamber inlet valve may control a flow of slurry through the slurry inlet channel, and thereby a flow of slurry from the slurry bypass channel into the metering chamber.

The slurry dispenser may also utilize an injection needle (or more generally a fluid injector) that may be placed in fluid communication with the metering chamber. This injection needle may extend through the slurry bypass channel and at least into the above-noted slurry inlet channel. It is also contemplated that the injection needle may extend completely through the slurry inlet channel, and either terminate at the inlet to the metering chamber or extend at least partially within the metering chamber. In any case, the metering chamber inlet valve may fluidly isolate the slurry bypass channel from the metering chamber by sealing against an exterior of this injection needle.

The injection needle may be disposed within a flow of slurry through the slurry bypass channel (including whenever a flow of slurry is being directed through the slurry bypass channel), within a flow of slurry through the slurry inlet channel (including whenever a flow of slurry is being directed through the slurry inlet channel), or both. In one embodiment, the injection needle is disposed transversely to a flow of slurry through the slurry bypass channel and is disposed parallel to a flow of slurry through the slurry inlet channel. The injection needle may be sized so that slurry may flow around the injection needle when slurry is being directed through the slurry bypass channel, through the slurry inlet channel, or both. For instance, the effective outer diameter of the injection needle may be smaller than the effective inner diameter of each of the slurry bypass channel and the slurry inlet channel to allow slurry to flow around the injection needle in the above-noted manner and still remain within the confines of the corresponding slurry bypass/inlet channel. The term "effective outer diameter" is intended to allow the injection needle to have other than a circular outer diameter, and for one or each of the slurry bypass channel and the slurry inlet channel to have other than a circular cross-section taken perpendicularly to a flow therethrough.

The slurry dispenser may include a controller of any appropriate type that is configured to execute a container slurry-loading sequence or protocol, including when the above-noted injection needle is utilized. This container slurry-loading sequence may entail closing the metering chamber outlet valve (e.g., via appropriate signaling; to fluidly isolate the metering chamber from a container into which slurry is to be dispensed), simultaneously or thereafter opening the metering chamber inlet valve, (e.g., via appropriate signaling; to allow at least part of the slurry from the slurry bypass channel to flow into the metering chamber), thereafter closing the metering chamber inlet valve (e.g., via appropriate signaling; to fluidly isolate the metering chamber from the slurry bypass channel), and simultaneously/thereafter opening the metering chamber outlet valve (e.g., via appropriate signaling; to allow a metered quantity of slurry to be dispensed from the slurry dispenser and into any appropriate container). In the case where the above-noted injection needle is being used by the slurry dispensing system, the container slurry-loading sequence/protocol may be further configured to initiate a fluid flow through the injection needle at any appropriate type and for any appropriate purpose. For instance, fluid may be discharge from the injection needle and into the metering chamber some time after the metering chamber inlet valve has been closed. This introduction of fluid into the slurry-containing metering chamber may be used to facilitate the dispensing of the metered quantity of slurry from the metering chamber. This introduction of fluid into the metering chamber also may be used to flush the metering chamber. In any case, representative fluids for such introduction into the metering chamber include without limitation air, water, acidic or caustic solution, or solvents.

Each of the metering chamber inlet valve and the metering chamber outlet valve may be of any appropriate size, shape, configuration, and/or type. For instance, each of these valves may include a flexible or deflectable portion that may be flexed/deflected to close or block an associated flow path. In one embodiment, each of the metering chamber inlet and outlet valves is air-actuated (or using some other appropriate activating fluid). Air pressure may be exerted on the metering chamber inlet valve to configure this valve to block a flow of slurry through the above-noted slurry inlet channel (e.g., to fluidly isolate the metering chamber from the slurry bypass channel). Air pressure may be exerted on the metering chamber outlet valve to configure this valve to block a flow of slurry out of the metering chamber, for instance by sealing an outlet extending from the metering chamber (e.g., to fluidly isolate the metering chamber from a container into which the slurry is to be dispensed). An elasticity of the flexible or deflectable portions of both the metering chamber inlet and outlet valves may provide the sole force to return these valves return to their original shape (after the activating air pressure is terminated or is at least sufficiently reduced) and which may then re-open the associated flow path. Therefore, each of the metering chamber inlet and outlet valves may be two-state valves of sorts—either allowing flow through the associated flow path or terminating flow through the associated flow path.

A sixth aspect of the present invention is directed to a method of dispensing slurry. The method includes mixing a fluid and a plurality of particles in the mixer, providing a slurry flow out of the mixer to a slurry dispenser, and discharging a metered quantity of slurry from the slurry dispenser into a container. This discharging of a metered quantity of slurry includes operating the slurry dispenser in accordance with a programmed protocol (e.g., automatically).

A number of feature refinements and additional features are applicable to the sixth aspect of the present invention. These feature refinements and additional features may be used individually or in any combination. As such, each of the following features that will be discussed may be, but are not required to be, used with any other feature or combination of features of the sixth aspect. The following discussion is applicable to at least this sixth aspect. Any appropriate fluid and any appropriate particles may be mixed within the mixer and in any appropriate manner. However, in one embodiment, the horizontal mixer discussed above in relation to the first and second aspects is used by this sixth aspect as well. Slurry may be provided from the mixer to the slurry dispenser in any appropriate manner. In one embodiment, a peristaltic pump is operated to pump the slurry from the mixer to the slurry dispenser.

Slurry from the mixer may be directed into a first flow path of the slurry dispenser (e.g., a slurry bypass channel). A first part of this slurry (e.g., less than the entirety of the slurry being directed into the first flow path) in turn may be directed into a metering chamber of the slurry dispenser. The first flow path may extend through a corresponding portion of the slurry dispenser to a dispenser recirculation port. The portion of the flow of slurry through the first flow path, that is not directed into the metering chamber, may be directed out of the dispenser recirculation port for recirculation back to the mixer.

Directing a first part of the slurry, that is flowing through the first flow path, into the metering chamber may entail fluidly connecting a metering chamber inlet with the first flow path of the slurry dispenser. Slurry may continue to flow through the first flow path (e.g., and out the above-noted dispenser recirculation port for recirculation back to the mixer) as slurry is also be directed into the metering chamber. The discharging of a metered quantity of slurry may also entail fluidly isolating a metering chamber inlet from the first flow path, as well as fluidly connecting a metering chamber outlet with the container. Slurry may also continue to flow through the first flow path (e.g., and out the above-noted dispenser recirculation port for recirculation back to the mixer) when the metering chamber is fluidly isolated from this first flow path, including as slurry is being dispensed from the metering chamber and into the container.

The slurry dispenser may include a metering chamber inlet valve and a metering chamber outlet valve for the noted metering chamber, and slurry from the mixer may be initially directed into a first flow path of the slurry dispenser. A programmed protocol may be executed to control the operation of these two valves for each container that is to be loaded with slurry using the method of the sixth aspect. The programmed protocol may alleviate the need for operation interaction to manually control these two valves. Initially, the metering chamber outlet valve may be closed by programmed protocol (e.g., by appropriate signaling to the metering chamber outlet valve, for instance, from a controller). With the metering chamber outlet valve being closed, the metering chamber inlet valve may then be opened by the programmed protocol (e.g., by appropriate signaling to the metering chamber inlet valve, for instance, from a controller). Slurry flowing through the first flow path is thereby allowed to now flow into the metering chamber. Once a desired quantity of slurry has been directed into the metering chamber (e.g., on a timed basis), the metering chamber inlet valve may be closed by the programmed protocol (e.g., by appropriate signaling to the metering chamber inlet valve, for instance, from a controller). This then fluidly isolates the metering chamber from the first flow path through the slurry dispenser. With the metering chamber inlet valve now being closed, the metering chamber outlet valve may be opened by the programmed protocol (e.g., by appropriate signaling to the metering chamber outlet valve, for instance, from a controller). As such, slurry may be directed out of the metering chamber and into the container.

Slurry that is directed into the slurry dispenser, but which does not flow into the metering chamber, may be recirculated back to the mixer. Slurry may continue to flow through the first flow path of the slurry dispenser and back to the mixer while the metering chamber is being loaded with slurry, as the slurry is being dispensed from the metering chamber, or both. Slurry may continually flow through the slurry dispenser. In any case, a first fluid (in addition to the slurry) may be directed into the metering chamber at any appropriate time and for any appropriate purpose, for instance after slurry has been loaded therein and with the metering chamber being fluidly isolated from the first flow path. This fluid may be pressurized to an appropriate level and may be in the form of air, water, or solvents. For instance, this fluid may be directed into the metering chamber through an injection needle as described above in relation to the fifth aspect.

A number of feature refinements and additional features are separately applicable to each of above-noted first, second, third, and fourth aspects of the present invention. These feature refinements and additional features may be used individually or in any combination in relation to each of the above-noted first, second, third, fourth, fifth, and sixth aspects. Any feature of any other various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a slurry dispensing system includes "a pump" alone does not mean that the slurry dispensing system includes only a single pump). Any failure to use phrases such as "at least one" or the like also does not limit the corresponding feature to the singular (e.g., indicating that a slurry dispensing system includes "a pump" alone does not mean that the slurry dispensing system includes only a single pump). Use of the phrase "at least generally" or the like in relation to a particular feature encompasses the corresponding characteristic and insubstantial variations thereof (e.g., indicating that a mixer rotates about an axis that is at least generally horizontally disposed encompasses the mixer rotating about an axis that is in fact horizontal). Finally, a reference of a feature in conjunction with the phrase "in one embodiment" does not limit the use of the feature to a single embodiment.

DETAILED DESCRIPTION

Figure 1:
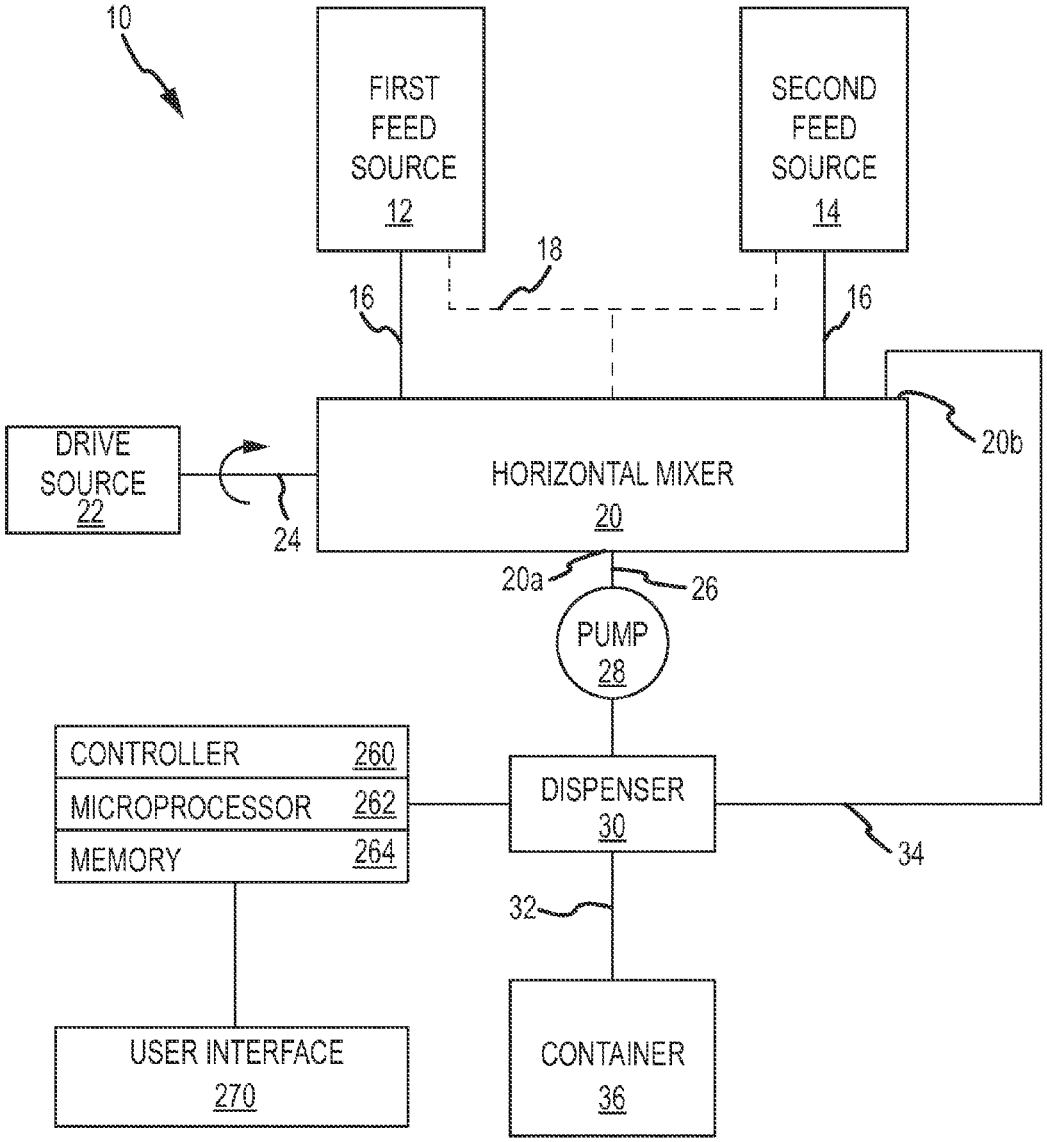
FIG. 1 is a schematic of a fluid or slurry dispensing system that utilizes a horizontal mixer.

FIG. 1 is a schematic representation of one embodiment of a fluid system 10 that may be used to provide a slurry to a desired slurry target. As such, the fluid system 10 could also be referred to as a slurry dispensing system 10. The fluid system 10 utilizes as least one feed source to direct slurry components into a horizontal mixer 20. In the illustrated embodiment, a first feed source 12 is fluidly connected with the horizontal mixer 20 and contains a first slurry component (e.g., particles or particulates). A second feed source 14 is also fluidly connected with the horizontal mixer 20 and contains a second slurry component (e.g., a fluid). A single feed source could be used to provide the slurry components to the horizontal mixer 20. Three or more feed sources could also be used to provide different slurry components to the horizontal mixer 20.

One or more feed sources could have a direct fluid connection with the horizontal mixer 20, two or more feed sources could have their outputs merged or combined prior to entering the horizontal mixer 20, or any combination thereof. A separate input or inlet line 16 may extend between the horizontal mixer 20 and each of the first feed source 12 and the second feed source 14 (indicated by the solid lines in FIG. 1). The output from the first feed source 12 and second feed source 14 alternatively may be directed into a common input or inlet line 18 (where their respective outputs are merged or combined, and indicated by the dashed line in FIG. 1) that extends to the horizontal mixer 20. The common input line 18 may include a common header or intake manifold that receives a flow, output, or discharge from each of the first feed source 12 and second feed source 14, and directs or introduces the same into the horizontal mixer 20 in the form of a single input or stream.

The mixer 20 used by the fluid system 10 is of the horizontal type—a mixer that rotates about an at least substantially horizontally disposed rotational axis. The horizontal mixer 20 is rotatably driven by a drive source 22. The output from the drive source 22 rotates a drive shaft 24, which in turn is appropriately interconnected with the horizontal mixer 20 to rotate the same. The drive source 22 may be of any appropriate size, shape, configuration, and/or type. Multiple drive sources could also be used to rotate the horizontal mixer 20.

Slurry from the horizontal mixer 20 may be withdrawn through an output or outline line 26. A pump 28 of any appropriate type (e.g., peristaltic) may be used to withdraw slurry from the horizontal mixer 20, to transfer the slurry to a desired slurry target, or both. In the illustrated embodiment, slurry from the horizontal mixer 20 is directed into a dispenser 30 via the output line 26. The dispenser 30 may be of any appropriate size, shape, configuration, and/or type. There are two available flow paths out of the dispenser 30. The dispenser 30 may direct slurry into a container 36 (e.g., a column, vial, or the like) via an output or outlet line 32. The dispenser 30 may also direct slurry back to the horizontal mixer 20 via a recirculation line 34. The dispenser 30 may be configured to direct a certain quantity of slurry into the container 36, while the remainder of the slurry being directed into the dispenser 30 may be recirculated back to the horizontal mixer 20 by the recirculation line 34. It should be appreciated that one or more valves, controllers, or the like (not shown) may be utilized by the fluid system 10 to control one or more aspects of its operation.

One embodiment of a horizontal mixer that may be used by the fluid system 10 of FIG. 1 is illustrated in FIGS. 2-7 and is identified by reference numeral 50. The horizontal mixer 50 may be used for any appropriate application, including medical applications that utilize a slurry (e.g., for the production of radioisotopes).

The horizontal mixer 50 includes a frame 52 that supports a tumbler, container, or mixer body 80, which in turn may be rotated relative to the frame 52 by a drive source 62 about an at least substantially horizontally disposed rotational axis 110. The frame 52 includes a bed 54. Multiple supports 56*a-c* extend from the bed 54 and may be integrated with the bed 54 in any appropriate manner. The drive source 62 may be supported by and mounted to the support 56*a* in any appropriate manner. The tumbler 80 may be located between the supports 56*b*, 56*c*. Further in this regard, a drive roller 58 extends between the supports 56*b*, 56*c*. Moreover, one idler roller 60 is rotatably supported by the support 56*b*, and another axially aligned idler roller 60 is rotatably supported by the support 56*c*. The rollers 58, 60 engage and support an exterior surface 84*b* of the tumbler 80 (e.g., the rollers 58, 60 collectively define a cradle that supports the tumbler 80). The pair of idler rollers 60 could be replaced by a single idler roller that extends between the supports 56*b*, 56*c* (not shown). The single drive roller 58 could be replaced by a pair of drive rollers (not shown, but where one such drive roller is rotatably supported by the support 56*b* and where another such drive roller is rotatably supported by the support 56*c*, for instance in the manner of the idler rollers 60).

In the illustrated embodiment, the drive roller 58 is rotated by the drive source 62. In this regard, a drive gear 64 is disposed between the supports 56*a*, 56*b*, and is rotatably driven by the output from the drive source 62. A driven gear 66 is also located between the supports 56*a*, 56*b*, and is interconnected with the drive gear 64 by a drive belt 68. Rotation of the drive gear 64 is thereby transmitted to the driven gear 66 by the drive belt 68. The driven gear 66 is appropriately interconnected with the drive roller 58. Rotation of the driven gear 66 thereby rotates the drive roller 58 (e.g., the driven gear 66 and the drive roller 58 rotate together and in the same direction).

The driver roller 58 is engaged with an exterior surface 84*b* of the tumbler 80 (specifically, its sidewall 82 or an outer sidewall 84*b*). Rotation of the drive roller 58 rotates (e.g., drives) the tumbler 80 about its rotational axis 110. The idler rollers 60 also engage the exterior surface 84*b* of the tumbler 80 (specifically, its outer sidewall 82). In the illustrated embodiment, the idler rollers 60 are "free spinning", such that rotation of the tumbler 80 causes the idler rollers 60 to rotate. Any appropriate way of rotating the tumbler 80 may be utilized. Any appropriate way of rotatably supporting the tumbler 80 may be utilized as well.

The tumbler 80 of the horizontal mixer 50 includes a tumbler or mixer sidewall 82 and a pair of tumbler or mixer ends 86*a*, 86*b* that are spaced along the rotational axis 110 and that collectively define a mixing chamber 90. One of the tumbler ends 86*a* (associated with the support 56*b* of the frame 52) includes an aperture or opening 88 through which an input/inlet line 70 and output/outlet line 72 may extend, and that will be discussed in more detail below. The tumbler end 86*a* could be disposed in sealing engagement with the support 56*b* (e.g., a seal that would allow the tumbler 80 to rotate relative to the support 56, and yet have a fluid-tight seal exist therebetween), or could be spaced therefrom. The tumbler end 86*b* is closed in the illustrated embodiment. The sidewall 82 may be of an at least generally cylindrical shape.

An interior surface 84*b* of the sidewall 82 (or an inner sidewall 84*b*) includes a plurality of blades or fins 92. Generally, these blades 92 are orientated relative to the rotational axis 110 of the tumbler 80 or promote a desired mixing action within the mixing chamber 90 (e.g., providing a desired level of homogeneity of particles within the slurry). This mixing action may be characterized as slurry within the tumbler 80 being folded onto itself during rotation of the tumbler 80 and by the action of the various blades 92. This mixing action may also be characterized as the blades 92 funneling or directing a flow to a common region 78 within the mixing chamber 90 through at least a certain rotational angle, where slurry may be removed from this common region 78 through the above-noted output line 72 that extends therein. The mixing action may also be characterized as the blades 92 both lifting a portion of the slurry and inducing a pressure gradient within the lifted slurry portion that directs the same toward the common region 78, again where slurry may be removed from this common region 78 through the output line 72 that extends in this common region 78. In one embodiment, the common region 78 is located at least generally mid-way between the ends 86*a*, 86*b* of the tumbler 80. Other locations may be appropriate.

Figure 2:
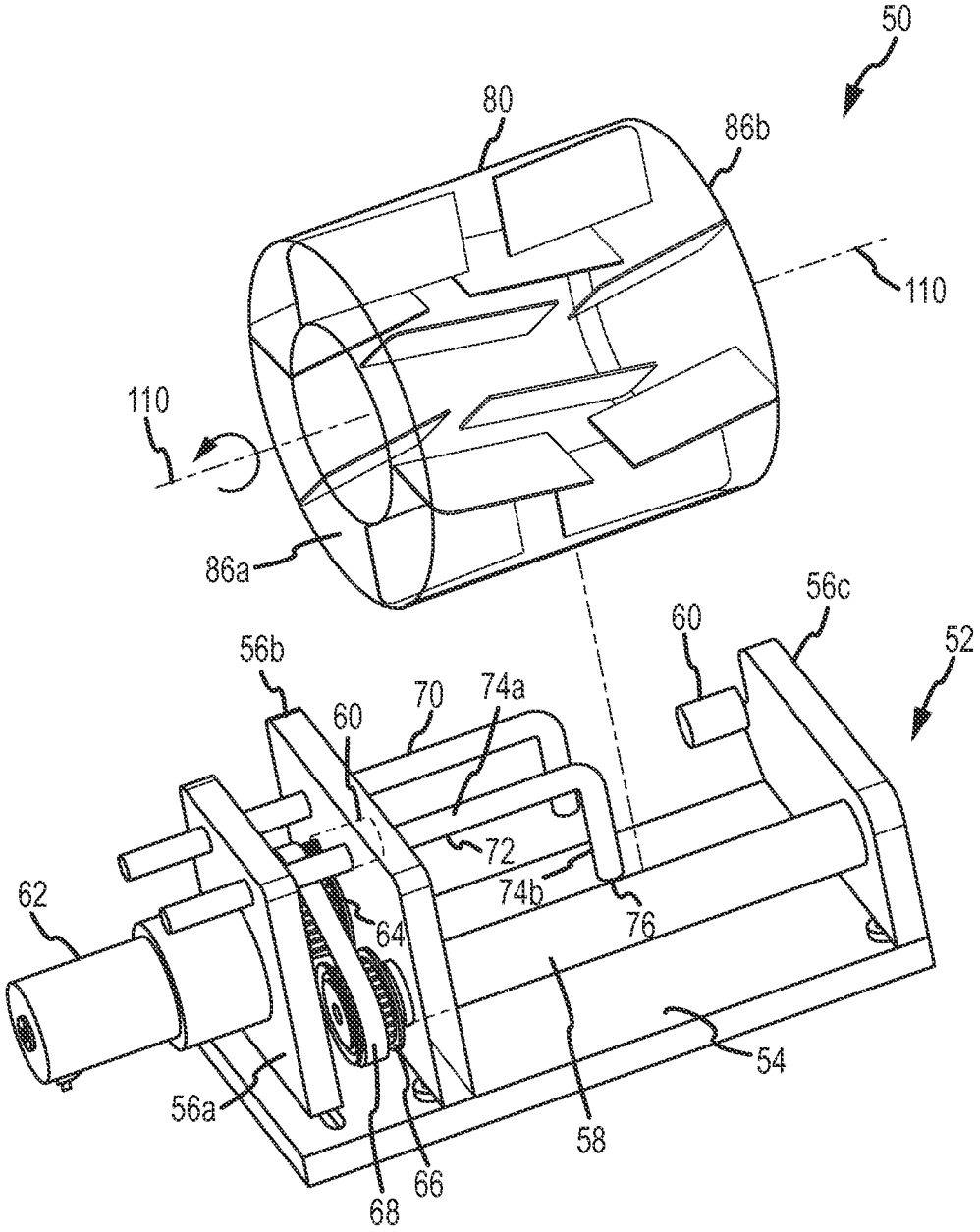
FIG. 2 is a perspective view of one embodiment of a horizontal mixer that may be used by the fluid system of FIG. 1, with the tumbler being exploded away from the frame, and with its various blades being shown in their entirety for clarity.
Figure 3:
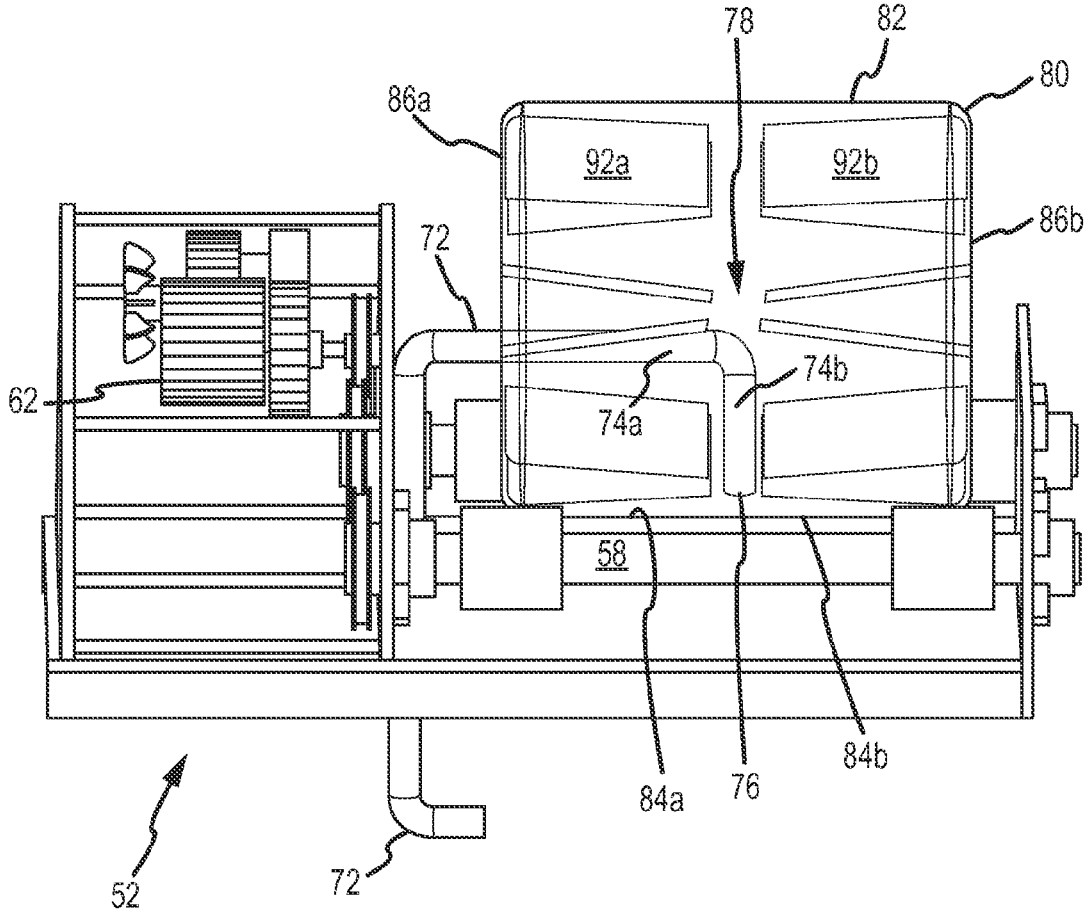
FIG. 3 is a side view of the horizontal mixer of FIG. 2, and with its various blades being shown in their entirety for clarity.
Figure 4:
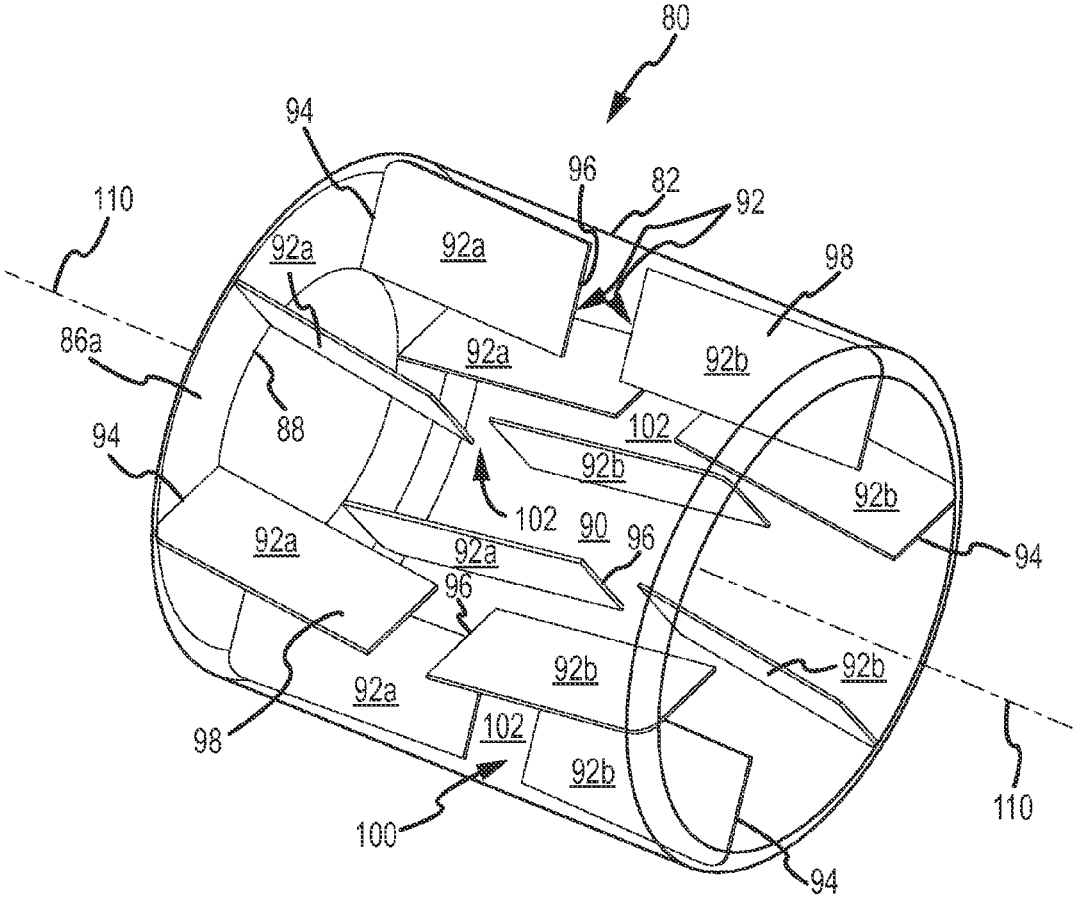
FIG. 4 is a perspective view of the tumbler from the horizontal mixer of FIG. 2, and with its various blades being shown in their entirety for clarity.
Figure 5A:
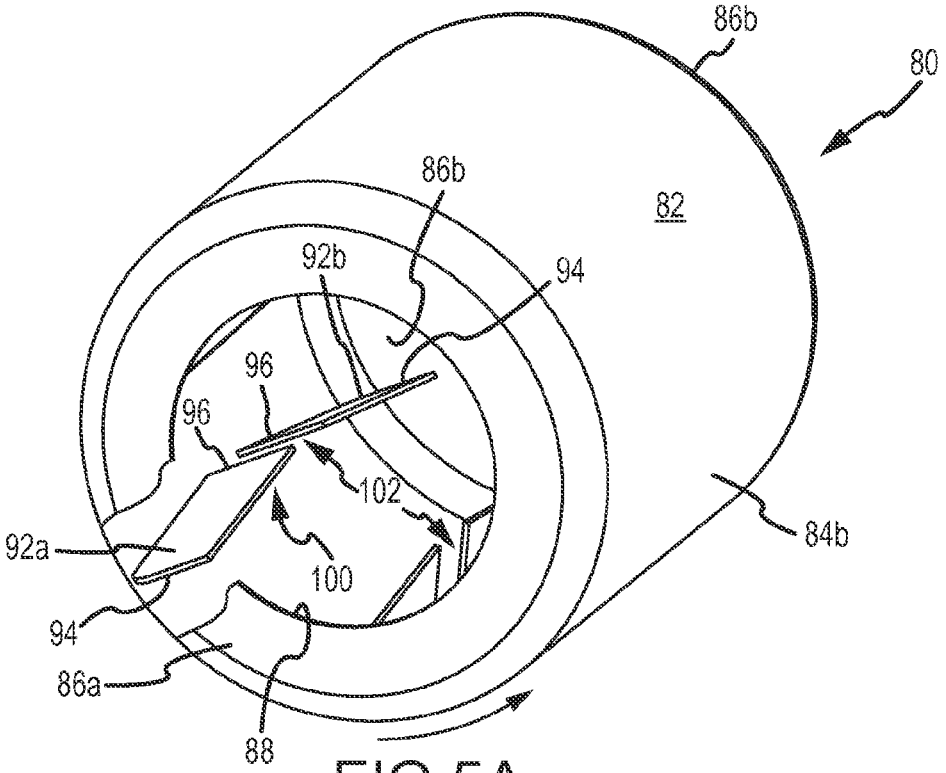
FIG. 5A is a perspective view of the interior of the tumbler of FIG. 4 and showing one of the blade pairs in about the 8 o'clock position.
Figure 5B:
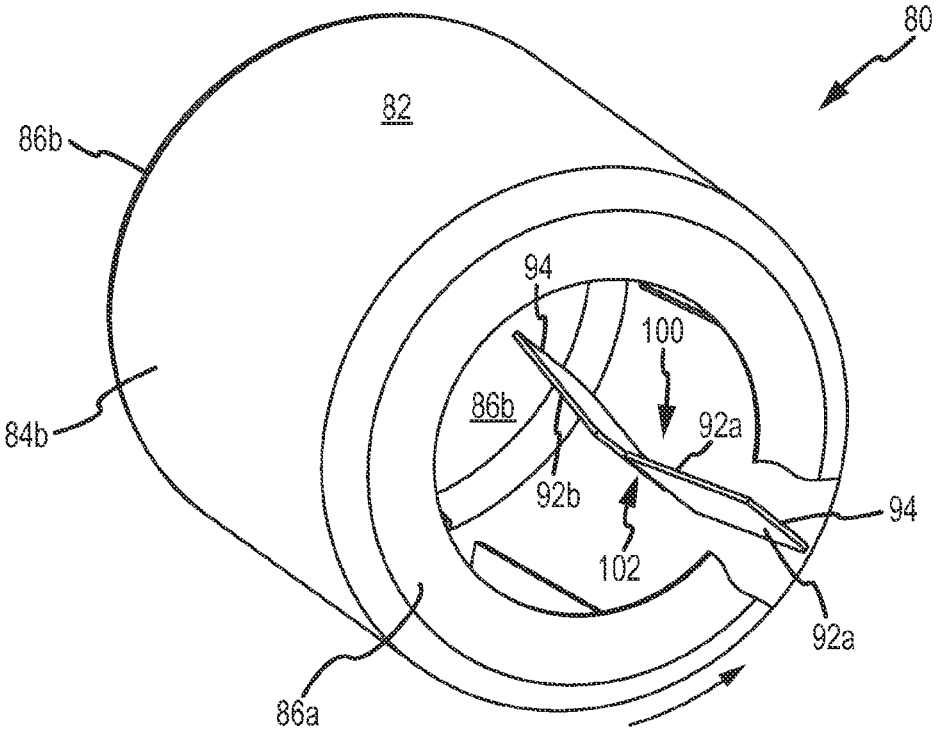
FIG. 5B is a perspective view of the interior of the tumbler of FIG. 4 and showing one of the blade pairs in about the 4 o'clock position.
Figure 6:
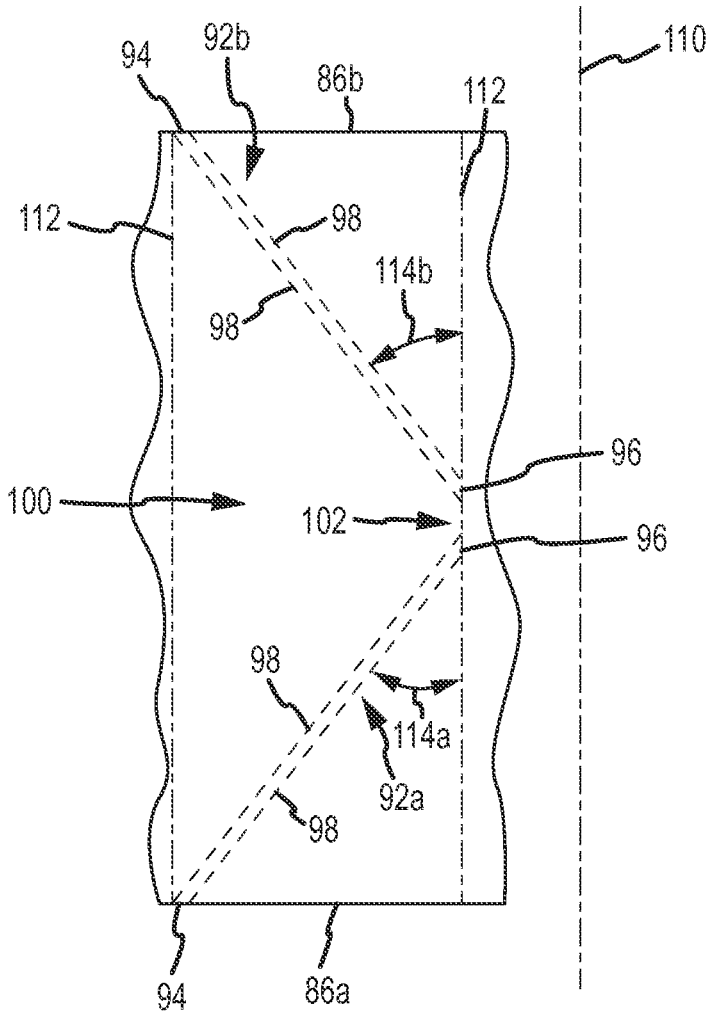
FIG. 6 is a plan view of part of the interior of the tumbler of FIG. 4, illustrating the orientation of one of its blade pairs.

The tumbler 80 of the horizontal mixer 50 is shown in each of FIGS. 2, 3, and 4. At least certain details regarding the blades 92 of the tumbler 80 are further shown in FIGS. 5A, 5B. Initially, it should be noted that the blades 92 extend from and rotate with the sidewall 82 of the tumbler 80 (specifically the interior surface 84*a* thereof). Any way of incorporating the blades 92 with the sidewall 82 of the tumbler 80 may be utilized (e.g., an integral or one-piece construction; having the blades 92 be separately attached or joined to the sidewall 82 and/or the corresponding tumbler end 86*a*, 86*b* in any appropriate manner). Generally, the blades 92 extend from the interior surface 84*a* of the sidewall 82 into the mixing chamber 90. This may be referred to as the "radial" direction or dimension. Although the blades 92 may extend orthogonally or perpendicularly from the interior surface 84*a* of the sidewall 82 (as shown in the illustrated embodiment), the blades 92 may extend from the interior surface 84*a* in other orientations.

The blades 92 of the tumbler 80 also extend along the interior surface 84 of the sidewall 82. This may be referred to as a longitudinal or length dimension. Each blade 92 includes a pair of primary surfaces 98 that are oppositely disposed. In the illustrated embodiment, these primary surfaces are flat or planar, although other contours/shapes may be appropriate.

There are basically two groups of blades 92 for the tumbler 80—a plurality of first blades 92*a* that extend at least generally from the first tumbler end 86*a*, and a plurality of second blades 92*b* that extend at least generally from the second tumbler end 86*b*. The outlet region 78 is located in the longitudinal dimension between the first blades 92*a* and the second blades 92*b*. As such, the plurality of first blades 92*a* may be characterized as being part of a first longitudinal segment of the tumbler 80, the outlet region 78 may be characterized as being part of a second longitudinal segment of the tumbler 80, and the plurality of second blades 92*b* may be characterized as being part of a third longitudinal segment of the tumbler 80. In the illustrated embodiment, these three longitudinal segments may be characterized as being disposed in non-overlapping relation. Another characterization may be that these three longitudinal segments are disposed in end-to-end relation and in the noted order, with the second longitudinal segment (including the outlet region 78) being located between the first longitudinal segment (including the first blades 92*a*) and the third longitudinal segment (including the second blades 92*b*) in the longitudinal dimension.

The output line 72 extends into the above-noted outlet region 78, which may be characterized as an intermediate longitudinal segment of the tumbler 80. In the illustrated embodiment, the output line 72 includes a first section 74*a* that extends at least primarily in the longitudinal dimension (e.g., at least generally parallel with the rotational axis 110), and a second section 74*b* that extends at least primarily in a downward direction. An end of the second section 74*b* includes an output/outlet port 76. The output port 76 is spaced from the interior surface 84*a* of the sidewall 82 for the tumbler 80. In one embodiment, the spacing between the output port 76 and the interior surface 84*a* is within a range of about 0.125 inches to about 0.135 inches. Generally, the output port 76 should be spaced from the interior surface 84*a* of the sidewall 82 of the tumbler 80 a sufficient distance so that the output port 76 does not become clogged. However, spacing the output port 76 too far away from the interior surface 84*a* of the sidewall 82 of the tumbler 80 is also undesirable in that it will leave a large quantity of slurry within the tumbler 80.

Each blade 92 includes a first blade end 94 and a second blade end 96. The length of a given blade 92 corresponds with the spacing between its first blade end 94 and its second blade end 96. In the case of the first blades 92*a*, the first blade end 94 may be located on or adjacent to the first tumbler end 86*a* and the second blade end 96 may be spaced from the first tumbler end 86*a* (e.g., each first blade 92*a* may be characterized as extending from the first tumbler end 86*a* at least generally in the direction of the second tumbler end 86*b*, but terminating prior to reaching the second tumbler end 86*b*). Stated another way, the second blade end 96 of each first blade 92*a* may be located between the second tumbler end 86*b* and its corresponding first blade end 94 in the longitudinal dimension.

In the case of the second blades 92*b*, the first blade end 94 may be located on or adjacent to the second tumbler end 86*b* and the second blade end 96 may be spaced from the second tumbler end 86*b* (e.g., each second blade 92*b* may be characterized as extending from the second tumbler end 86*b* at least generally in the direction of the first tumbler end 86*a*, but terminating prior to reaching the first tumbler end 86*a*). Stated another way, the second blade end 96 of each second blade 92*b* may be located between the first tumbler end 86*a* and its corresponding first blade end 94 in the longitudinal dimension.

Each of the blades 92 may be characterized as being "center angled." Center angling of the various blades 92 may promote a desired mixing action within the mixing chamber 90 of the horizontal mixer 50. A number of characterizations may be made in relation to the orientation of each blade 92 relative to the rotational axis 110 of the tumbler 80, which may apply individually or in any combination. Consider the case where a plurality of reference axes 112 are on the sidewall 82 of the tumbler 80 and are parallel to the rotational axis 110 of the tumbler 80. The first blade end 94 may be on one such reference axis 112 and its corresponding second blade end 96 may be on a different reference axis (e.g., FIG. 6) for each of the various blades 92, and which may be used to promote a desired mixing action in the mixing chamber 90 of the tumbler 80.

Each blade 92 may be of the same height, where "height" is the distance that the blades 92 extend away from where the blades 92 intersect with the interior surface 84*a* of the tumbler 80. The height of each blade 92 may be constant along the entire length thereof. In one embodiment, the first blade end 94 of each blade 92 at its intersection with the interior surface 84*a* of the tumbler 80 is at a different elevation than its corresponding second blade end 94 at its intersection with the interior surface 84*a*, where the elevation is measured relative to a horizontal reference plane located below the tumbler 80. In one embodiment, the elevation continually changes at the intersection between each blade 92 and the interior surface 84*a* of the tumbler 80 proceeding from its first blade end 94 to its corresponding second blade end 96, again where the elevation is measured relative to a horizontal reference plane located below the tumbler 80.

The first blade end 94 may leads its corresponding second blade end 96 in a first rotational direction in the case of each blade 92, and which may be used to promote a desired mixing action in the mixing chamber 90 of the tumbler 80. In the view shown in FIGS. 5A and 5B, the first rotational direction is counterclockwise. The arrow about the rotational axis 110 indicates the first rotational direction in each of FIGS. 2, 5A, 5B, and 7 (again, counterclockwise). Stated another way, the second blade end 96 may lag its corresponding first blade end 94 in a first rotational direction in the case of each blade 92.

Figure 7:
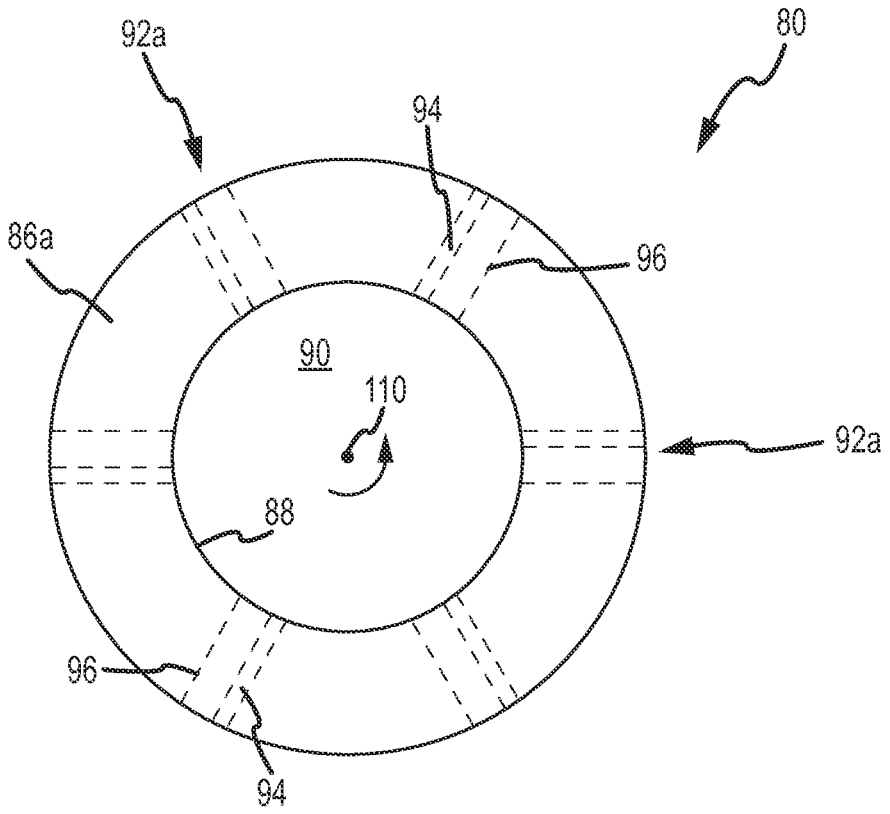
FIG. 7 is an end view of the tumbler of FIG. 4, illustrating the angular position and orientation of its plurality of first blades.

FIG. 7 further illustrates the above-noted leading/lagging relationship, with the arrow about the rotational axis 110 being the first rotational direction. In FIG. 7, the first blade end 94 of each first blade 92*a* is shown in dashed lines, as is an edge corresponding with each corresponding second blade end 96. During rotation of the tumbler 80 in the first rotational direction, the first blade end 94 of each first blade 92*a* will reach and pass the 6 o'clock position (such a "clock" being measured about the rotational axis 110) before its corresponding second blade end 96 reaches and passes the 6 o'clock position.

The various blades 92 for the mixer 50 are arranged so that there is a plurality of blade pairs 100 that are spaced about the rotational axis 110 (e.g., each blade pair being located at a different angular position relative to and measured about the rotational axis 110). Any number of blade pairs 100 may be utilized (6 blade pairs 100 in the illustrated embodiment). The blade pairs 100 are equally spaced about the rotational axis 100 in the illustrated embodiment, although other spacing arrangements could be utilized.

Each blade pair 100 includes one first blade 92*a* and one second blade 92*b*. In the illustrated embodiment, the first blade 92*a* and its corresponding second blade 92*b* (one first blade 92*a* and its corresponding second blade 92*b* defining a blade pair 100) are disposed in a mirror image relationship to each other. Referring back to FIG. 6, there is an included angle 114*a* between each first blade 92*a* and a reference axis 112 that is tangent to its second blade end 96 (again, where each reference axis 112 is parallel to the rotational axis 110), and there is an included angle 114*b* between each second blade 92*b* and a reference axis 112 that is tangent to its second blade end 96. In the illustrated embodiment, the magnitude of each included angle 114*a* is the same for all first blades 92*a*, the magnitude of each included angle 114*b* is the same for all second blades 92*b*, and the magnitudes of the included angles 114*a* and 114*b* are the same. This allows for the above-noted mirror image relationship. In one embodiment, each included angle 114*a*, 114*b* is within a range of about 3° to about 4°. The incline of the various blades 92*a*, 92*b* allows the output line 72, more specifically its output port 76, to be disposed in a "deeper reservoir" of slurry within the tumbler 80.

The various blade pairs 100 have an at least generally V-shaped profile. The second blade ends 96 of each blade pair 100 are separated by a gap 102 that coincides with the region 78 into which the output line 72 extends for withdrawing slurry from the mixer 50. The "V" of each blade pair 100 is oriented such that the noted gap 102 is the trailing portion of each blade pair 100 in the above-noted first rotational direction that is used for promoting a desired mixing action within the mixing chamber 90 during rotation of the tumbler 80 about its rotational axis 110 in the first rotational direction. Stated another way, the blade pairs 100 are orientated so each blade pair 100 is in the form of a concave structure in the first rotational direction (e.g., each blade pair 100 collectively defines an at least generally concave profile relative to the first rotational direction).

There are other alternatives in relation to the arrangement of the various first blades 92*a* and the various second blades 92*b*. The magnitude of the included angle 114*a* of each first blade 92*a* may be the same, the magnitude of the included angle 114*b* of each second blade 92*b* may be the same, but the magnitudes of the included angles 114*a* and included angles 114*b* may be different. It may be such that one or more different magnitudes are utilized for the included angle 114*a* of the various first blades 92*a* (e.g., one or more first blades 92*a* may be disposed at one common included angle 114*a*, while one or more other first blades 92*a* may be disposed at another common included angle 114*a*), that one or more different magnitudes are utilized for the included angle 114*b* of the various second blades 92*b* (e.g., one or more second blades 92*b* may be disposed at one common included angle 114*b*, while one or more other second blades 92*b* may be disposed at another common included angle 114*b*), or both.

Other arrangement of the first blades 92*a* relative to the second blades 92*b* may be utilized. For instance, the first blades 92*a* may be disposed about the rotational axis 110 in one pattern, and the second blades 92*b* may be disposed about the rotational axis 110 in a different pattern. The first blades 92*a* and second blades 92*b* may be disposed in staggered relation about the rotational axis 110. For instance, when the first blade end 94 of the first blades 92*a* are at the 2, 4, 6, 8, 10, and 12 o'clock positions in a first static position for the tumbler 80, the first blade end 94 of the second blades 92*b* may be at the 1, 3, 5, 7, 9, and 11 o'clock positions.

Figure 8:
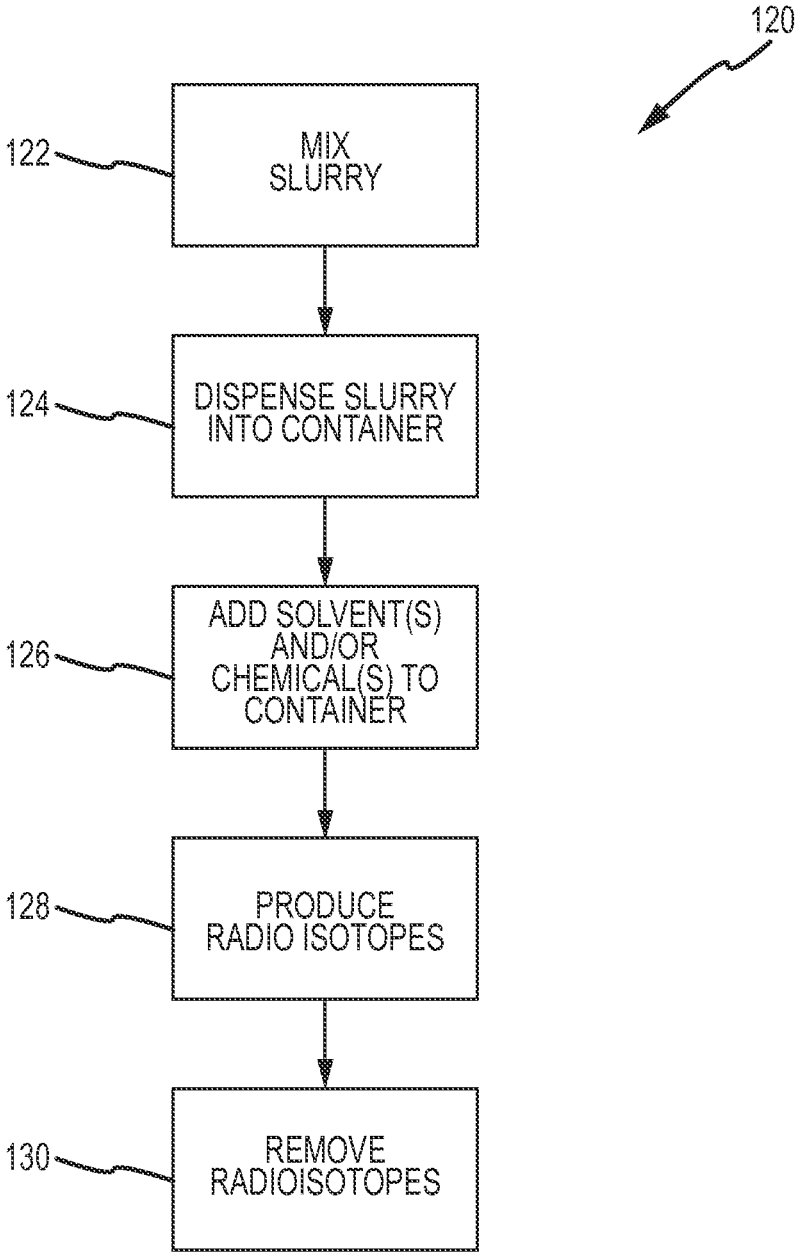
FIG. 8 is a schematic of one embodiment for producing radioisotopes.

The horizontal mixer 50 may be used in the fluid system 10 (in place of the horizontal mixer 20) to provide a slurry from which radioisotopes are produced. FIG. 8 illustrates one embodiment of such a production method 120. The production method 120 includes mixing a slurry (step 122). The horizontal mixer 50 may be used to mix such a slurry, including when incorporated into the fluid system 10. In one embodiment, the slurry includes particles of alumina. In other embodiments, other adsorbant or resin particles known in the chromatographic chemistry arts may be mixed in a slurry form.

The slurry may be dispensed into an appropriate container (e.g., a glass column) pursuant to step 124 of the production method 120. This may entail using an appropriate dispensing apparatus, or it may be done by hand. Once the slurry is added to the column, the column may be loaded with a chemical or compound that adsorbs to the adsorbant materials that were part of the slurry (Step 126). In one embodiment, the column is utilized in a technetium generator wherein molybdenium-99 is added to the column, adsorbing onto the alumina column packing material. Over time, the molybdenium-99 decays to technetium-99m, a daughter radioisotope that is used in many nuclear medicine procedures (Step 128). While molybdenium-99 remains adsorbed to alumina, technetium-99m washes off of the alumina when water is passed through the column. Chromatographic separation of technetium-99m from molybdenum-99 may therefore occur by passing a water eluant through the column (Step 130). The technetium-99m is then isolated and utilized in medical applications such as medical diagnosis, medical treatment, and medical research.

Figure 9:
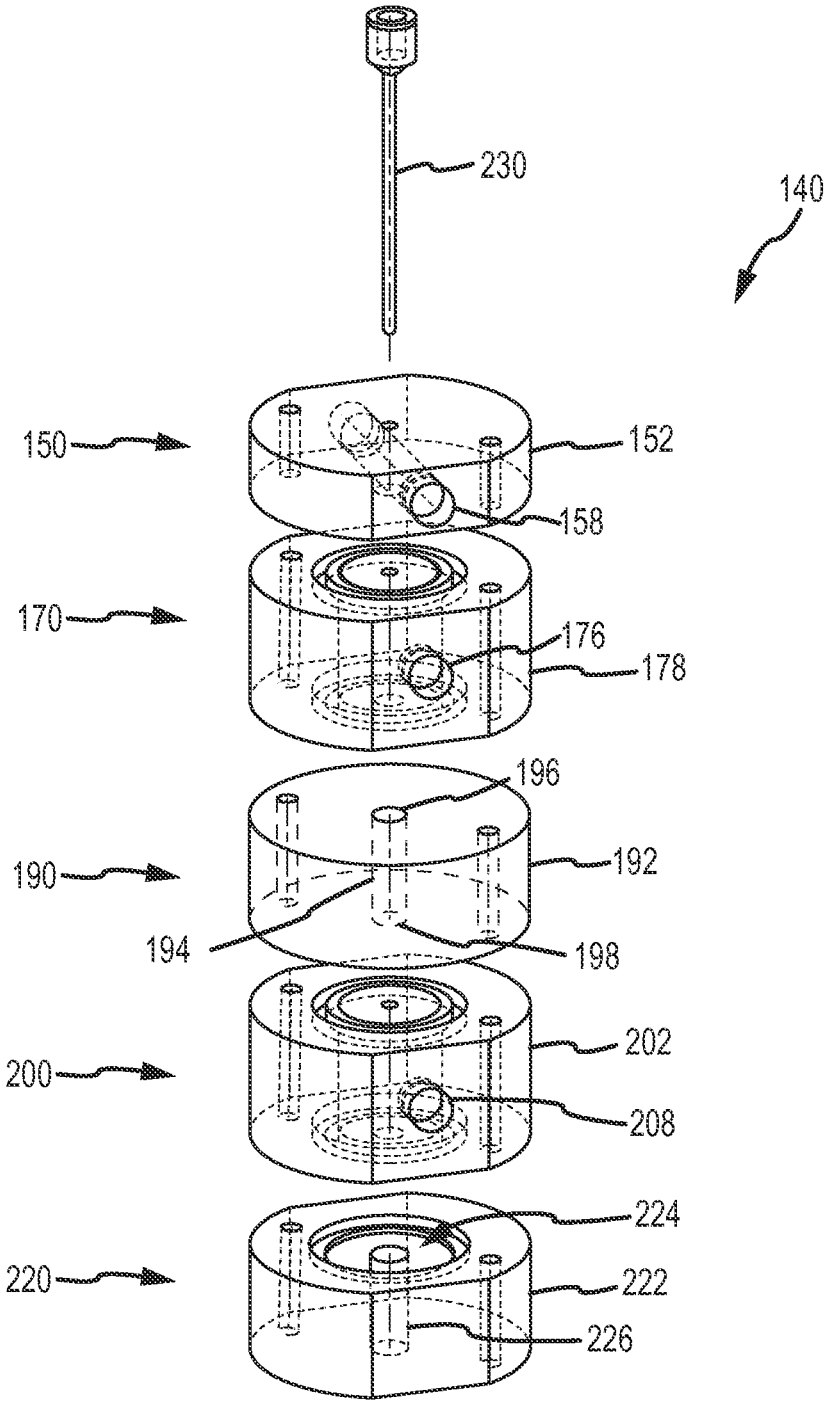
FIG. 9 is a perspective view of one embodiment of a slurry dispenser that may be used by the slurry dispensing system of FIG. 1.
Figure 10:
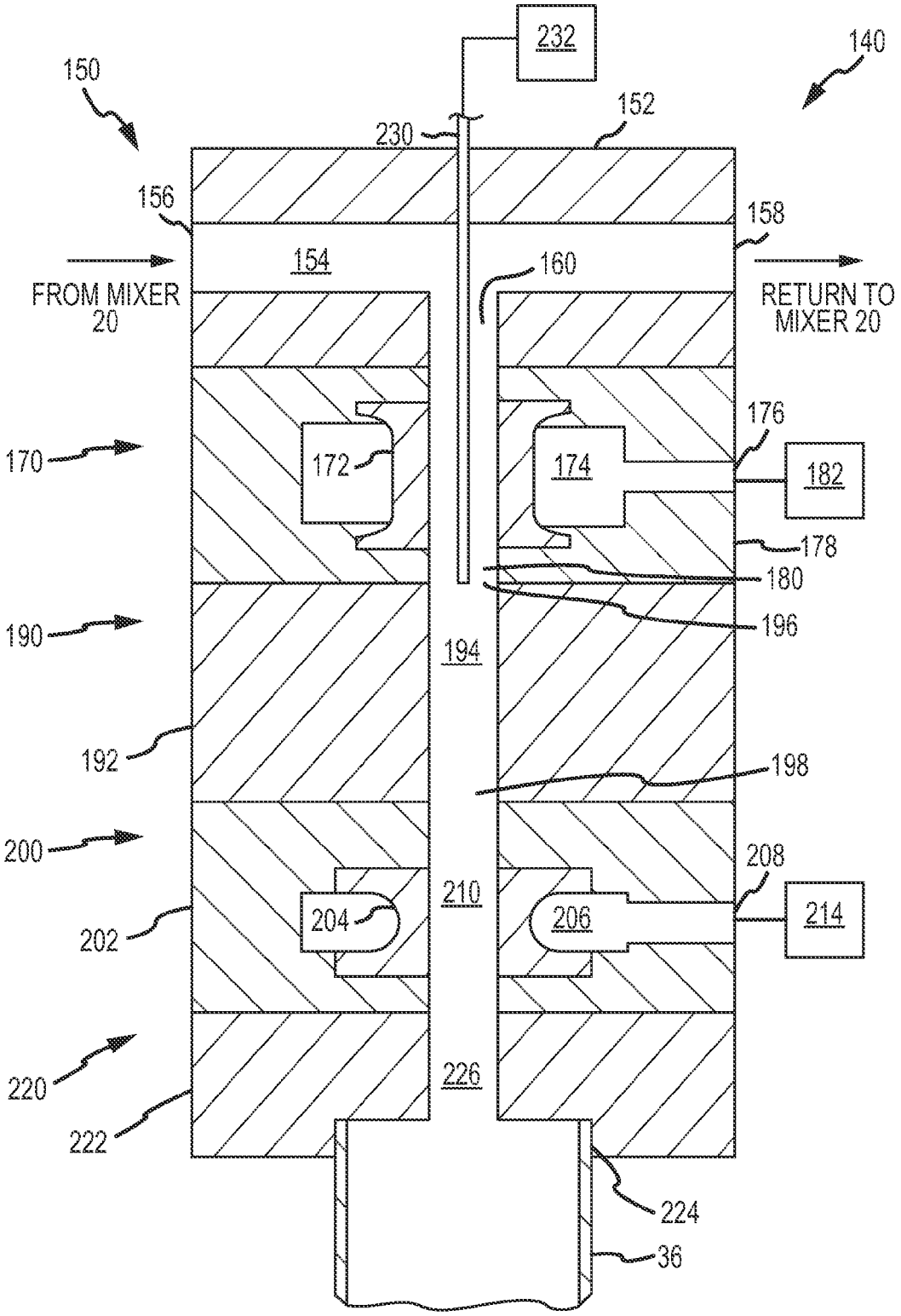
FIG. 10 is a cross-sectional view of the slurry dispenser of FIG. 9.

FIGS. 9-10 present one embodiment of a slurry dispenser 140. This slurry dispenser 140 may be used by the slurry dispensing system 10 of FIG. 1 in place of the dispenser 30, and including in the practice of the radioisotope production method 120 illustrated in FIG. 8. Generally, the slurry dispenser 140 is able to provide a metered quantity of slurry on an automated or at least semi-automated basis.

The slurry dispenser 140 may provide a metered quantity of slurry to an appropriate container 36. Components of the slurry dispenser 140 include a slurry bypass section 150, a slurry bypass valve section 170, a metering section 190, a dispensing valve section 200, and a container holder/alignment section 220. A slurry flow from the mixer 20 (FIG. 1) may be introduced into the slurry bypass section 150. The dispensing valve section 200 may be configured (e.g., via programmed control) to fluidly isolate the metering section 190 from the container 36, and the slurry bypass valve section 170 may be configured (e.g., via programmed control) to establish a fluid flow path between the slurry bypass section 150 and the metering section 190 (e.g., to establish fluid communication). As such, at least part of the slurry flow being directed into the slurry dispenser 140 may, in turn, be directed into the metering section 190. Typically, part of the slurry flow will be directed from the slurry bypass section 150 into the metering section 190, while a remainder of the slurry flow being introduced into the slurry bypass section 150 will be recirculated back to the mixer 20 (FIG. 1). When a desired quantity of slurry exists within the metering section 190, the slurry bypass valve section 170 may be configured (e.g., via programmed control) to fluidly isolate the slurry bypass section 150 from the metering section 190. Thereafter, the dispensing valve section 200 may be configured (e.g., via programmed control) to provide a fluid flow path between the metering section 190 and the container 36. As such, slurry from the metering chamber section 190 may be dispensed into the container 36. This general protocol or sequence may be repeated for each container slurry-loading operation (e.g., to sequentially provide a metered quantity of slurry into a plurality of containers 36).

The slurry bypass section 150 receives a slurry flow from the mixer 20 (FIG. 1). A slurry bypass channel 154 extends through a slurry bypass housing 152 of the slurry bypass section 150. One end of the slurry bypass channel 154 may be characterized as a dispenser inlet port 156. A flow path (e.g., output line 26 in FIG. 1) extends between the dispenser inlet port 156 and an outlet 20*a* of the mixer 20. An opposite end of the slurry bypass channel 154 may be characterized as a dispenser recirculation port 158. A flow path (e.g., recirculation line 34 in FIG. 1) extends between the dispenser recirculation port 158 and a recirculation port 20*b* of the mixer 20.

The slurry flow from the mixer 20 may enter the slurry bypass channel 154 via the dispenser inlet port 156, may flow through the slurry bypass channel 154, and may exit the slurry bypass channel 154 via the dispenser recirculation port 158 where this slurry flow is then directed back to the mixer 20—all when the slurry bypass valve section 170 is configured (e.g., by programmed control) to fluidly isolate the slurry bypass channel 154 from the metering section 190. When a container 36 is appropriately positioned relative to the slurry dispenser 140 (e.g., interfacing with the container holder/alignment section 220), the slurry bypass valve section 170 may be configured (e.g., by programmed control) to allow slurry from the slurry bypass channel 154 to be directed into the metering section 190. At this time, slurry may continue to flow out of the dispenser recirculation port 158 and back to the mixer 20. In any case and to accommodate the provision of slurry from the slurry bypass channel 154 to the metering section 190, the slurry bypass section 150 further includes a slurry flow channel 160. This slurry flow channel 160 intersects with the slurry bypass channel 154 somewhere between its dispenser inlet port 156 and dispenser recirculation port 158, and extends to a perimeter or exterior of the slurry bypass housing 152.

Each of the slurry bypass channel 154 and the slurry flow channel 160 may be of any appropriate size, shape, and/or configuration. For instance, although each of the slurry bypass channel 154 and the slurry flow channel 160 are linear in the illustrated embodiment, other orientations/configurations may be appropriate. In the illustrated embodiment, a flow through the slurry bypass channel 154 is orthogonal to a flow through the slurry flow channel 160.

The slurry bypass valve section 170 controls the flow of slurry between the slurry bypass section 150 and the metering section 190. The slurry bypass valve section 170 includes a slurry bypass valve housing 178 that may be disposed in interfacing relation with an end of the slurry bypass housing 152. The slurry bypass housing 152 includes a slurry flow channel 180 that extends completely through the slurry bypass valve housing 178. One end of the slurry flow channel 180 adjoins a corresponding end of the slurry flow channel 160 of the slurry bypass section 150. As such, slurry may be directed from the slurry bypass channel 154 of the slurry bias pass section 150, into the slurry flow channel 160 of the slurry bypass section 150, and into the slurry flow channel 180 of the slurry bypass valve section 170, and ultimately into the metering section 190. Collectively, the slurry flow channel 160 and the slurry flow channel 180 may be characterized as a slurry inlet channel for the metering section 190, specifically, its metering chamber 194.

A bypass valve 172 controls the flow through the slurry flow channel 180 of the slurry bypass valve section 170. The bypass valve 172 may be of any appropriate size, shape, configuration, and/or type. In the illustrated embodiment, the bypass valve 172 is in the form of a hollow, flexible structure (the slurry flow channel 180 extending through the bypass valve 172). The bypass valve 172 may be actuated in any appropriate manner. In the illustrated embodiment, the bypass valve 172 is air-actuated, although other appropriate actuating fluids could be utilized. As such, the slurry bypass valve housing 178 includes a pressurizing air chamber 174 that is disposed about the bypass valve 172, and a pressurizing air port 176 that extends to this pressurizing air chamber 174. Pressurized air from a pressurizing air source 182 may be directed through the pressurizing air port 176 and into the pressurizing air chamber 174 (e.g., via programmed control) to compress the bypass valve 172 (e.g., in a radially-inward direction). Compression of the bypass valve 172 blocks the slurry flow channel 180 to fluidly isolate the slurry bypass section 150 from the metering section 190. As such, slurry within the slurry flow channel 160 of the slurry bypass section 150 is not able to reach the metering section 190 at this time.

The metering section 190 receives slurry from the slurry bypass section 150 and may dispense a metered quantity of slurry (e.g., via programmed control) to a container 36. The metering section 190 includes a metering chamber housing 192. One end of the metering chamber housing 192 may be disposed in interfacing relation with a corresponding end of the slurry bypass valve housing 178. Therefore and in the case of the illustrated embodiment, the slurry bypass valve housing 178 may be characterized as being sandwiched between the slurry bypass housing 152 and the metering chamber housing 192.

A metering chamber 194 exists within the metering chamber housing 192. A metering chamber inlet 196 may be disposed adjacent to a corresponding end of the slurry flow channel 180 through the slurry bypass valve section 170. Although the bypass valve 172 is illustrated as being at least slightly spaced back from the metering chamber inlet 196, the bypass valve 172 could be disposed adjacent to the metering chamber inlet 196. However, part of the metered quantity of slurry to be dispensed from the slurry dispenser 140 could be contained within the portion of the slurry flow channel 180 that is located between the bypass valve 172 and the metering chamber 194. The metering chamber 194 also includes a metering chamber outlet 198 through which slurry may be dispensed to a container 36.

The dispensing valve section 200 controls the flow of slurry between the metering section 190 and the container 36. The dispensing valve section 200 includes a dispensing valve housing 202 that may be disposed in interfacing relation with an end of the metering chamber housing 192. The dispensing valve housing 202 includes a slurry flow channel 210 that extends completely through the dispensing valve housing 202. One end of the slurry flow channel 210 adjoins a corresponding end of the metering chamber 194 of the metering section 190. As such, slurry may be directed from the metering chamber 194 of the metering section 190 and into the slurry flow channel 210 of the dispensing valve section 200.

A dispensing valve 204 controls the flow through the slurry flow channel 210 of the dispensing valve section 200, and thereby the flow out of the metering section 190. The dispensing valve 204 may be of any appropriate size, shape, configuration, and/or type. In the illustrated embodiment, the dispensing valve 204 is in the form of a hollow, flexible structure (the slurry flow channel 210 extending through the dispensing valve 204). The dispensing valve 204 may be actuated in any appropriate manner. In the illustrated embodiment, the dispensing valve 204 2 is air-actuated, although other appropriate actuating fluids may be utilized.

As such, the dispensing valve housing 202 includes a pressurizing air chamber 206 that is disposed about the dispensing valve 204, and a pressurizing air port 208 that extends to this pressurizing air chamber 206. Pressurized air from a pressurizing air source 214 may be directed through the pressurizing air port 208 and into the pressurizing air chamber 206 (e.g., via programmed control) to compress the dispensing valve 204 (e.g., in a radially-inward direction). Compression of the dispensing valve 204 blocks the slurry flow channel 210 to fluidly isolate the metering section 190 from the container 36. As such, slurry within the slurry flow channel 210 of the dispensing valve section 200 that is upstream of the dispensing valve 204 (and including slurry in the metering chamber 194) is not able to reach the container 36 at this time.

Although the dispensing valve 204 is illustrated as being at least slightly spaced downstream of the metering chamber outlet 198 of the metering section 190, the dispensing valve 204 could be disposed adjacent to the metering chamber 198. However, part of the metered quantity of slurry to be dispensed from the slurry dispenser 140 could be contained within the portion of the slurry flow channel 210 that is located between the dispensing valve 204 and the metering chamber 194.

The container holder/alignment section 220 receives slurry (e.g., a metered quantity) from the dispensing valve section 200 and directs the same into a properly positioned container 36. The container holder/alignment section 220 includes a container holder/alignment housing 222. One end of the container holder/alignment housing 222 may be disposed in interfacing relation with a corresponding end of the dispensing valve housing 202. Therefore and in the case of the illustrated embodiment, the dispensing valve housing 202 is sandwiched between the container holder/alignment housing 222 and the metering chamber housing 192. A slurry flow channel 226 extends through the container holder/alignment housing 222 to a container receptacle 224 in which at least an end portion of the container 36 may be disposed. A flow of slurry into the slurry flow channel 226 is thereby directed into the container 36. The container 36 may be maintained in position for receiving slurry from the slurry flow channel 226 of the container holder/alignment section 220 in any appropriate manner. Any appropriate way of providing a seal between the container 36 and the slurry dispenser 140 may be utilized.

The slurry dispenser 140 as described may be used to deliver a metered quantity of slurry from the mixer 20 to a container 36 (FIG. 1). This metered quantity may coincide with introducing slurry into the metering chamber 194 on a timed basis. The slurry dispenser 140, however, is not limited to only providing a metered quantity of slurry. In any case, FIGS. 9 and 10 illustrate a further component that may be utilized by the slurry dispenser 140 and that may enhance one or more aspects relating to the delivery of slurry to the container 36. An injector or injection needle 230 extends into the slurry dispenser 140 in the illustrated embodiment. More specifically, the injection needle 230 extends through the slurry bypass channel 154 and slurry flow channel 160 of the slurry bypass section 150, and through the slurry flow channel 180 of the slurry bypass valve section 170. In the illustrated embodiment, the injection needle 230 terminates at the metering chamber inlet 196 of the metering chamber 194. Notwithstanding the illustrated relative positioning of the injection needle 230 and the internal flow path through the slurry dispenser 152 to the metering chamber 194, other relative positionings may be utilized. For instance, the injection needle 230 could merely extend through the slurry bypass channel 154, through the slurry flow channel 160, and at least slightly past the location of the bypass valve 172 in the slurry flow channel 180 (e.g. so that fluid may be discharged from the injection needle 230 at a location that is downstream of the bypass valve 172 when it is in its closed configuration). In this regard, when the bypass valve 172 is moved to its closed position (e.g., via programmed control), the bypass valve 172 may seal against an exterior of the injection needle 230 to block the flow of slurry into the metering chamber 194 from the slurry bypass channel 154.

The injection needle 230 is disposed perpendicularly to a flow through the slurry bypass channel 154, and is disposed parallel to a flow through the slurry flow channel 160 and the slurry flow channel 180. The injection needle 230 is sized so that flow through the slurry bypass section 150 is able to flow around an exterior of the injection needle 230. Moreover, the injection needle 230 is sized so that flow through the slurry flow channel 160 and the slurry flow channel 180 is able to flow around an exterior of the injection needle 230. For instance, the effective diameter of the injection needle 230 within the slurry bypass channel 154 may be smaller than the effective diameter of the portion of the slurry bypass channel 154 through which the injection needle 230 extends. Moreover, the effective diameter of the injection needle 230 within the slurry flow channel 160 may be smaller than the effective diameter of the portion of the slurry flow channel 160 through which the injection needle 230 extends. Finally, the effective diameter of the injection needle 230 within the slurry flow channel 180 may be smaller than the effective diameter of the portion of the slurry flow channel 180 through which the injection needle 230 extends. Positioning the injection needle 230 within at least part of a flow path through the slurry dispenser 140 may be advantageous in maintaining a desired homogeneity of particles within the slurry. For instance, this may create a disturbance or eddy current, adding to the mixing of particles as the slurry passes the injection needle 230 (a secondary action (e.g., in the form of an eddy current) may also be present and/or generated when the slurry bypass valve 172 opens). This injection needle 230 again helps redirect the slurry into the metering chamber 194.

A fluid source 232 is fluidly connected with the injection needle 230, and may contain a fluid of any appropriate type (e.g., air, water, or solvent). Generally, fluid from the fluid source 232 may be directed through the injection needle 230 and discharged into the metering chamber 194 at any appropriate time and for any appropriate purpose. For instance, this fluid injection may occur when the bypass valve 172 is in its closed position or configuration. More specifically, the fluid may be discharged from the injection needle 230 in conjunction with dispensing slurry from the metering chamber 194. This fluid from the injection needle 230 could be used to facilitate the flow of slurry out of the metering chamber 194 (e.g., by being directed into the metering chamber 194 under a suitable pressure before or after the dispensing valve 204 has been opened to "push" the slurry out of the dispensing chamber 194 and into the container 36). This fluid from the injection needle 230 may also be used to flush the metering chamber 194 after the slurry has been dispensed therefrom. The slurry dispenser 140 may be operated on automated or at least semi-automated basis in relation to the dispensing of a metered quantity of slurry into the container 36, including when the slurry dispenser 140 replaces the dispenser 30 in the slurry dispensing system 10 of FIG. 1. In this regard, a controller 260 may be operatively interconnected with the slurry dispenser 140. This controller 260 may be of any appropriate configuration, for instance including an appropriate microprocessor 262 and memory 264. A user interface 270 of any appropriate type may be used to communicate with the controller 260. The user interface 270 may be used to provide one or more inputs to the controller 260 in any appropriate manner relating to the desired manner of controlling at least the slurry dispenser 140, to display information relating to the controller 260 and/or the slurry dispenser 140, or both. Generally, the controller 260 may be configured to control the opening and closing of each of the bypass valve 172 and dispensing valve 204, as well as the delivery of fluid from the fluid source 232 to the injection needle 230.

Figure 11:
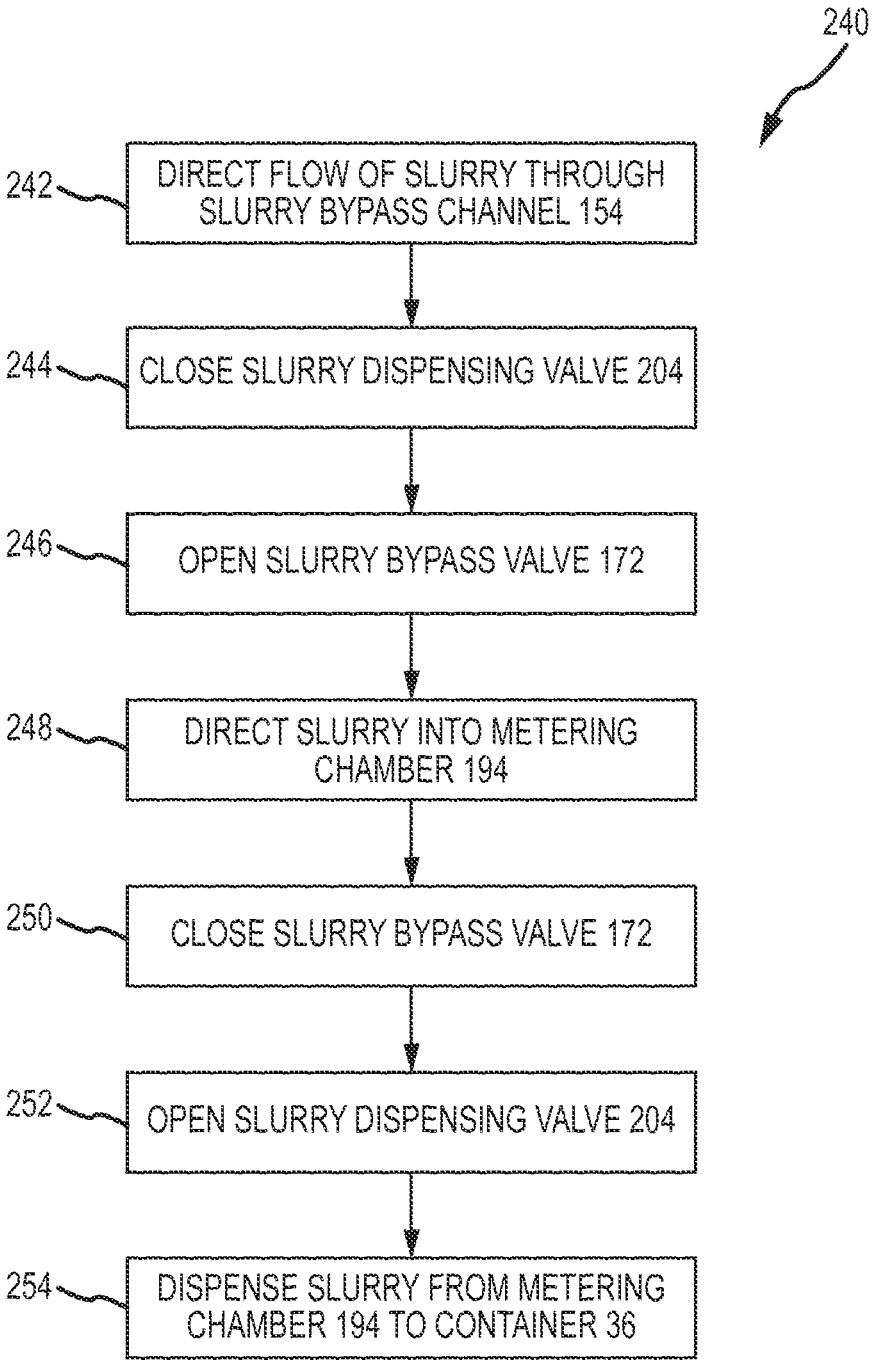
FIG. 11 is a schematic of one embodiment of a container slurry-loading protocol/sequence.

One embodiment of a container slurry-loading sequence or protocol that may be programmed into the controller 260 in any appropriate manner is illustrated in FIG. 11 and is identified by reference numeral 240. A flow of slurry from the mixer 22 to the slurry dispenser 140 may be initiated pursuant to step 242 of this container slurry-loading protocol 240. For instance, the controller 260 may signal one or more of the drive source 22 for the mixer 20, the peristaltic pump 28, and any valving in the output line 26. In any case, slurry is directed into the slurry bypass channel 154 of the slurry dispenser 140 pursuant to step 242. Again, at least part of this flow may be directed out of the dispenser recirculation port 158 of the slurry dispenser 140 and recirculated back to the mixer 20 via the recirculation line 34.

The slurry dispensing valve 204 may be closed to fluidly isolate the metering chamber 194 from a container 36 that is in proper position for receiving slurry from the slurry dispenser 140 (e.g., disposed within the container receptacle 224 of the container holder/alignment section 220) pursuant to step 244 of the protocol 240. The controller 260 may signal the pressurizing air source 214 to initiate a delivery of air under pressure to the pressurizing air port 208, which then directs this pressurized air into the pressurizing air chamber 206 that surrounds the dispensing valve 204. A sufficient increase of pressure within the pressurizing air chamber 206 will compress the dispensing valve 204 to fluidly isolate the metering chamber 194 from the container 36, or to preclude flow between the metering chamber 194 and the container 36 (e.g. by having the valve 204 block the slurry channel 210.

The slurry bypass valve 172 may be opened to provide a flow path between the slurry bypass section 150 of the slurry dispenser 140 (specifically the slurry bypass channel 154 and the slurry flow channel 160) and the metering chamber 194 pursuant to step 246 of the protocol 240. The controller 260 may signal the pressurizing air source 182 to terminate a delivery of air under pressure to the pressurizing air port 176 (or to at least reduce the air flow into the air pressurizing chamber 174 that surrounds the slurry bypass valve 172), to allow the slurry bypass valve 172 to move to its open position (FIG. 10). The elasticity of the slurry bypass valve 172 may provide the sole force for moving the slurry bypass valve 172 from its closed position (where it fluidly isolates the slurry bypass section 150 from the metering chamber 194) to its open position (where a flow path exists from the slurry bypass channel 154 to the metering chamber 194). There may be circumstances where different configurations of the bypass valve 172 may be appropriate, including where an actuation signal is used to provide a motive force to move the bypass valve 172 to its open position and where an elasticity of the bypass valve 172 is used to move the bypass valve 172 from its open position to its closed position, or where an actuation signal is used to provide a motive force to move the bypass valve 172 to each of its open and closed positions (not shown).

Step 246 of the container slurry-loading protocol 240 (opening of the slurry bypass valve 172 via programmed control) may be executed after step 244 (closure of the slurry dispensing valve 244 via programmed control). In at least some circumstances it may be appropriate for steps 244 and 246 of the container slurry-loading protocol 240 to be executed simultaneously. For instance, this simultaneous opening of the slurry bypass valve 172 and closing of the slurry dispensing valve 244 may be utilized to allow for "filling" of the metering chamber 194 where accuracy is less important. The loading in this case is controlled by flow over time and for instances where exact metering is not needed and/or is not as important.

After the slurry dispensing valve 204 has been closed (step 244) and after the slurry bypass valve 172 has been opened (step 246), the container slurry-loading protocol 240 directs slurry into the metering chamber 194 (step 248). The slurry flowing through the slurry bypass channel 154 of the slurry bypass section 150 is able to flow into the slurry flow channel 160 of the slurry bypass section 150, into the slurry flow channel 180 of the slurry bypass valve section 170, and into the metering chamber 194. As the slurry dispensing valve 204 has been previously closed (step 244), slurry is unable to progress to the container 36 at this time.

When a desired or metered quantity of slurry has been directed into the metering chamber 194, the slurry bypass valve 172 may be closed via programmed control (step 250). This once again fluidly isolates the slurry bypass section 150 from the metering chamber 194—slurry is no longer able to flow from slurry bypass channel 154 and slurry flow channel 160 of the slurry bypass section 150 into the metering chamber 194. Any appropriate basis may be used to determine how much slurry should be directed into the metering chamber 194. For instance, the controller 260 may be configured to maintain the slurry bypass valve 172 in an open configuration for a predetermined amount of time, which should correspond with providing a certain quantity of slurry into the metering chamber 194 assuming a constant flow rate through the slurry bypass channel 154. In any case, when a determination has been made that the slurry bypass valve 172 should be closed via programmed control (step 250), the controller 260 may signal the pressurizing air source 182 to initiate a delivery of air under pressure to the pressurizing air port 176, which then directs this pressurized air into the pressurizing air chamber 174 that surrounds the slurry bypass valve 172. A sufficient increase of pressure within the pressurizing air chamber 174 will compress the slurry bypass valve 172 to fluidly isolate the slurry bypass section 150 from the metering chamber 194 (e.g. by having the slurry bypass valve 172 block the slurry channel 180).

Typically after the slurry bypass valve 172 has been closed (step 250), the slurry dispensing valve 204 may be opened via programmed control (252). However, there may be circumstances where the closing of the slurry bypass valve 172 (step 250) and the opening of the dispensing valve 204 (step 252) may be undertaken on a simultaneous basis. Opening the dispensing valve 204 provides a flow path between the metering chamber 194 and the container 36. The controller 260 may signal the pressurizing air source 214 to terminate a delivery of air under pressure to the pressurizing air port 208 (or to at least reduce the air flow into the air pressurizing chamber 206 that surrounds the dispensing valve 204), to allow the dispensing valve 204 to move to its open position (FIG. 10). The elasticity of the dispensing valve 204 may provide the sole force for moving the dispensing valve 204 from its closed position (where it fluidly isolates the metering chamber 194 from the container 36) to its open position (where a flow path exists from the metering chamber 194 and the container 36). As in the case of the slurry bypass valve 172, there may be circumstances where different configurations of the dispensing valve 204 may be appropriate, including where an actuation signal is used to provide a motive force to move the dispensing valve 204 to its open position and where an elasticity of the dispensing valve 204 is used to move the dispensing valve 204 from its open position to its closed position, or where an actuation signal is used to provide a motive force to move the dispensing valve 204 to each of its open and closed positions (not shown).

After the dispensing valve 204 has been opened via programmed control (step 252), the slurry from the metering chamber 194 may be dispensed into the container 36 (e.g., via the slurry flow channel 226). Gravitational forces may provide the sole force for directing the slurry out of the metering chamber 194 and into the container 36. However and as discussed above, an appropriate fluid (e.g., air or water) may be introduced into the metering chamber 194 to facilitate the removal of the slurry from the bypass channel. In this regard, the controller 260 may signal the fluid source 232 to initiate a flow of fluid into the injection needle 230, and into the metering chamber 194. This flow of fluid may also be initiated to flush the metering chamber 194 after the slurry has been dispensed into the container 36.

Based upon the foregoing, it should be appreciated that at the slurry dispenser 140 may be operated under programmed control. This programmed control may at least in part be time-based. For instance, the bypass valve 172 may be opened to initiate a flow of slurry into the metering chamber 194 with the dispensing valve 204 being in a closed configuration. After the expiration of a programmed amount of time (e.g., input to the controller 260 via the user interface 270), the bypass valve 172 may be closed by the controller 260 and the dispensing valve 204 may be opened.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A slurry dispensing system comprising: 1) a slurry mixer comprising a mixer outlet and a mixer recirculation port; and 2) a slurry dispenser fluidly connectable with said slurry mixer and comprising:

a slurry bypass channel fluidly connectable with each of said mixer outlet and said mixer recirculation port;

a metering chamber;

a metering chamber inlet valve between said slurry bypass channel and said metering chamber;

a metering chamber outlet valve for said metering chamber;

a slurry inlet channel extending from said slurry bypass channel to said metering chamber, wherein said metering chamber inlet valve controls a flow through said slurry inlet channel to said metering chamber;

an injection needle in fluid communication with said metering chamber; and a controller configured to execute a container slurry-loading sequence comprising closing said metering chamber outlet valve, thereafter opening said metering chamber inlet valve, thereafter closing said metering chamber inlet valve, thereafter opening said metering chamber outlet valve, and initiating a fluid flow through said injection needle after said metering chamber inlet valve has been closed.

2. The slurry dispensing system of claim 1, further comprising:

at least one feed source fluidly connectable with said slurry mixer, wherein a fluid and a plurality of particles are directed into said slurry mixer by said at least one feed source, and wherein a discharge out of said mixer outlet comprises a slurry.

3. The slurry dispensing system of claim 1, wherein said slurry mixer comprises a horizontal mixer.

4. The slurry dispensing system of claim 1, further comprising:

a pump between said mixer outlet and said slurry dispenser.

5. The slurry dispensing system of claim 4, wherein said pump comprises a peristaltic pump.

6. The slurry dispensing system of claim 1, wherein said slurry bypass channel comprises a dispenser inlet port and a dispenser recirculation port, wherein said slurry dispensing system further comprises:

an outlet line extending between said mixer outlet and said dispenser inlet port; and a recirculation line extending between said dispenser recirculation port and said mixer recirculation port.

7. The slurry dispensing system of claim 6, wherein said slurry inlet channel intersects said slurry bypass channel between said dispenser inlet port and said dispenser recirculation port.

8. The slurry dispensing system of claim 1, wherein said injection needle extends through said slurry bypass channel and at least into said slurry inlet channel.

9. The slurry dispensing system of claim 8, wherein said injection needle extends through said slurry inlet channel and at least to said metering chamber.

10. The slurry dispensing system of claim 1, wherein said injection needle is disposed within a flow through said slurry bypass channel and is also disposed within a flow through said slurry inlet channel.

11. The slurry dispensing system of claim 10, wherein said injection needle is disposed transversely to said flow through said slurry bypass channel and is disposed parallel to said flow through said slurry inlet channel.

12. The slurry dispensing system of claim 1, wherein an effective outer diameter of said injection needle is smaller than an effective diameter of each of said slurry bypass channel and said slurry inlet channel.

13. The slurry dispensing system of claim 1, wherein said metering chamber inlet valve seals against said injection needle to fluidly isolate said slurry bypass channel from said metering chamber.

14. The slurry dispensing system of claim 1, wherein said slurry dispenser further comprises a fluid injector fluidly connectable with said metering chamber.

15. The slurry dispensing system of claim 14, wherein said fluid injector is configured to deliver a fluid to said metering chamber when said metering chamber inlet valve is closed and when said metering chamber outlet valve is open to facilitate removal of slurry from said metering chamber.

16. The slurry dispensing system of claim 14, wherein said fluid injector is configured to deliver a fluid to said metering chamber when said metering chamber inlet valve is closed and when said metering chamber outlet valve is open to flush said metering chamber.

17. The slurry dispensing system of claim 15, wherein said fluid is selected from the group consisting of air, water, or solvents.

18. The slurry dispensing system of claim 1, further comprising a container fluidly connectable with said slurry dispenser.

19. A slurry dispensing system comprising: 1) a slurry mixer comprising a mixer outlet and a mixer recirculation port; and 2) a slurry dispenser fluidly connectable with said slurry mixer and comprising:

a slurry bypass channel fluidly connectable with each of said mixer outlet and said mixer recirculation port;

a metering chamber;

a metering chamber inlet valve between said slurry bypass channel and said metering chamber;

a metering chamber outlet valve for said metering chamber;

a slurry inlet channel extending from said slurry bypass channel to said metering chamber, wherein said metering chamber inlet valve controls a flow through said slurry inlet channel to said metering chamber; and an injection needle in fluid communication with said metering chamber, wherein said injection needle extends through said slurry bypass channel and at least into said slurry inlet channel, and wherein said injection needle extends through said slurry inlet channel and at least to said metering chamber.

20. The slurry dispensing system of claim 19, wherein said slurry bypass channel comprises a dispenser inlet port and a dispenser recirculation port, wherein said slurry mixer comprises a horizontal mixer, and wherein said slurry dispensing system further comprises:

at least one feed source fluidly connectable with said slurry mixer, wherein a fluid and a plurality of particles are directed into said slurry mixer by said at least one feed source, and wherein a discharge out of said mixer outlet comprises a slurry;

a peristaltic pump between said mixer outlet and said slurry dispenser;

an outlet line extending between said mixer outlet and said dispenser inlet port; and a recirculation line extending between said dispenser recirculation port and said mixer recirculation port.

21. The slurry dispensing system of claim 20, wherein said slurry inlet channel intersects said slurry bypass channel between said dispenser inlet port and said dispenser recirculation port.

22. The slurry dispensing system of claim 19, wherein said injection needle is disposed transversely to a flow through said slurry bypass channel and is disposed parallel to said flow through said slurry inlet channel.

23. The slurry dispensing system of claim 19, wherein an effective outer diameter of said injection needle is smaller than an effective diameter of each of said slurry bypass channel and said slurry inlet channel.

24. The slurry dispensing system of claim 19, wherein said metering chamber inlet valve seals against said injection needle to fluidly isolate said slurry bypass channel from said metering chamber.

25. The slurry dispensing system of claim 19, wherein said slurry dispenser further comprises a fluid injector fluidly connectable with said metering chamber.

26. The slurry dispensing system of claim 25, wherein said fluid injector is configured to deliver a fluid to said metering chamber when said metering chamber inlet valve is closed and when said metering chamber outlet valve is open to facilitate removal of slurry from said metering chamber.

27. The slurry dispensing system of claim 25, wherein said fluid injector is configured to deliver a fluid to said metering chamber when said metering chamber inlet valve is closed and when said metering chamber outlet valve is open to flush said metering chamber.

28. A slurry dispensing system comprising: 1) a slurry mixer comprising a mixer outlet and a mixer recirculation port; and 2) a slurry dispenser fluidly connectable with said slurry mixer and comprising:

a slurry bypass channel fluidly connectable with each of said mixer outlet and said mixer recirculation port;

a metering chamber;

a metering chamber inlet valve between said slurry bypass channel and said metering chamber;

a metering chamber outlet valve for said metering chamber;

a slurry inlet channel extending from said slurry bypass channel to said metering chamber, wherein said metering chamber inlet valve controls a flow through said slurry inlet channel to said metering chamber; and an injection needle in fluid communication with said metering chamber, wherein said injection needle is disposed within a flow through said slurry bypass channel and is also disposed within a flow through said slurry inlet channel, and wherein said injection needle is disposed transversely to said flow through said slurry bypass channel and is disposed parallel to said flow through said slurry inlet channel.

29. A slurry dispensing system comprising: 1) a slurry mixer comprising a mixer outlet and a mixer recirculation port; and 2) a slurry dispenser fluidly connectable with said slurry mixer and comprising:

a slurry bypass channel fluidly connectable with each of said mixer outlet and said mixer recirculation port;

a metering chamber;

a metering chamber inlet valve between said slurry bypass channel and said metering chamber;

a metering chamber outlet valve for said metering chamber;

a slurry inlet channel extending from said slurry bypass channel to said metering chamber, wherein said metering chamber inlet valve controls a flow through said slurry inlet channel to said metering chamber; and an injection needle in fluid communication with said metering chamber, wherein said metering chamber inlet valve seals against said injection needle to fluidly isolate said slurry bypass channel from said metering chamber.

* * * * *